US007219491B2

(12) United States Patent
Nakatani

(10) Patent No.: US 7,219,491 B2
(45) Date of Patent: May 22, 2007

(54) EXHAUST EMISSION CONTROL APPARATUS OF INTERNAL COMBUSTION ENGINE AND METHOD THEREOF

(75) Inventor: Koichiro Nakatani, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/614,903

(22) Filed: Jul. 9, 2003

(65) Prior Publication Data

US 2004/0011026 A1 Jan. 22, 2004

(30) Foreign Application Priority Data

Jul. 17, 2002 (JP) ..... 2002-208425

(51) Int. Cl.
*F01N 3/00* (2006.01)

(52) U.S. Cl. ..... 60/286; 60/274; 60/276; 60/295; 60/296; 60/301

(58) Field of Classification Search ..... 60/274, 60/286–288, 295, 301, 276, 296
See application file for complete search history.

(56) References Cited

U.S. PATENT DOCUMENTS

| | | | | |
|---|---|---|---|---|
| 5,085,049 | A * | 2/1992 | Rim et al. | 60/274 |
| 5,365,734 | A * | 11/1994 | Takeshima | 60/288 |
| 5,406,790 | A * | 4/1995 | Hirota et al. | 60/276 |
| 5,457,958 | A * | 10/1995 | Boegner et al. | 60/279 |
| 6,105,365 | A * | 8/2000 | Deeba et al. | 60/274 |
| 6,679,052 | B2 * | 1/2004 | Nakatani et al. | 60/297 |
| 6,735,940 | B2 * | 5/2004 | Stroia et al. | 60/288 |

FOREIGN PATENT DOCUMENTS

| | | |
|---|---|---|
| JP | A-07-259541 | 3/1994 |
| JP | A-6-129237 | 5/1994 |
| JP | A-7-97917 | 4/1995 |
| JP | A-09-53496 | 8/1995 |
| JP | A-10-339195 | 12/1998 |
| JP | A-2001-271637 | 3/2000 |
| JP | A-2001-317338 | 4/2000 |
| JP | A-2001-342819 | 3/2001 |

* cited by examiner

*Primary Examiner*—Thomas Denion
*Assistant Examiner*—Diem Tran
(74) *Attorney, Agent, or Firm*—Oliff & Berridge, PLC

(57) ABSTRACT

An exhaust emission control apparatus includes a $NO_X$ catalyst provided within an exhaust passage of an internal combustion engine where fuel combustion is continuously performed at a lean air/fuel ratio, and a reducing agent supply valve within the exhaust passage upstream of the $NO_X$ catalyst. If the $NO_X$ stored in the $NO_X$ catalyst is required to be decreased, a selector valve position is selected between a forward and a reverse flow positions so as to decrease a flow rate of the exhaust gas flowing through the $NO_X$ catalyst. Then a reducing agent is supplied upon elapse of a predetermined time period from the timing when the signal instructing to select the position of the selector valve. An oxygen sensor detects an oxygen concentration of the exhaust gas discharged from the $NO_X$ catalyst upon supply of the reducing agent. The elapsing time is corrected such that a peak value of the detected oxygen concentration accords with the target value.

16 Claims, 25 Drawing Sheets

48 ···OXYGEN SENSOR
61 ···SELECTOR VALVE
67 ···ANNULAR EXHAUST PIPE
69 ···PARTICULATE FILTER
77 ···REDUCING AGENT SUPPLY VALVE
81 ···NOx CATALYST

EXHAUST EMISSION CONTROL APPARATUS OF INTERNAL COMBUSTION ENGINE AND METHOD THEREOF

INCORPORATION BY REFERENCE

The disclosure of Japanese Patent Application No.2002-208425 filed on Jul. 17, 2002, including the specification, drawings and abstract are incorporated herein by reference in its entirety.

BACKGROUND OF THE INVENTION

1. Field of Invention

The invention relates to an exhaust emission control apparatus and a control method of an internal combustion engine.

2. Description of Related Art

There is a known internal combustion engine for combustion of fuel at a lean air/fuel ratio having a $NO_X$ catalyst disposed within an exhaust passage. The $NO_X$ catalyst stores $NO_X$ contained in exhaust gas flowing into the $NO_X$ catalyst at a lean air/fuel ratio, and reduces the stored $NO_X$ under the presence of a reducing agent contained in the exhaust gas upon decrease in the air/fuel ratio. The aforementioned internal combustion engine further includes a bypass passage that extends to branch off from the exhaust passage upstream of the $NO_X$ catalyst, and a bypass control valve that serves to adjust a flow rate of the exhaust gas flowing into the bypass passage so as to control the flow rate of the exhaust gas flowing through the $NO_X$ catalyst. A reducing agent supply valve through which the reducing agent is supplied to the $NO_X$ catalyst is disposed within the exhaust passage between the point where the bypass passage is branched and the $NO_X$ catalyst. In the above-structured internal combustion engine, the flow rate of the exhaust gas flowing through the $NO_X$ catalyst is temporarily decreased by the bypass control valve, and at the same time, the reducing agent is supplied from the reducing agent supply valve.

The above structure may decrease the quantity of the reduction agent which is required to set the air/fuel ratio of the exhaust gas flowing into the $NO_X$ catalyst to the rich or the theoretical state by decreasing the flow rate of the exhaust gas upon supply of the reducing agent through the reducing agent supply valve. As the space velocity of the exhaust gas within the $NO_X$ catalyst is decreased, the quantity of the reducing agent flowing through the $NO_X$ catalyst without causing reaction can be decreased, resulting in efficient use of the reducing agent.

The above-structured internal combustion engine controls the bypass control valve such that the flow rate of the exhaust gas flowing into the $NO_X$ catalyst sequentially changes from the timing when the flow rate begins decreasing until it resumes the originally set value. The reducing agent may be efficiently used at an optimum flow rate of the exhaust gas flowing through the $NO_X$ catalyst upon supply of the reducing agent through the reducing agent supply valve. It is, therefore, preferable to determine the timing at which the flow rate of the exhaust gas flowing through the $NO_X$ catalyst becomes the optimum value for the efficient use of the reducing agent. This makes it possible to supply the reducing agent through the reducing agent supply valve at the determined timing.

Each of the bypass control valves, however, widely varies in terms of performance. This may cause the flow rate of the exhaust gas flowing through the $NO_X$ catalyst to become larger or smaller than the optimum value even if the reducing agent is supplied at the determined timing.

SUMMARY OF THE INVENTION

It is an object of the invention to provide an exhaust emission control apparatus of an internal combustion engine, which is capable of appropriately holding the flow rate of the exhaust gas flowing through the $NO_X$ catalyst upon supply of the reducing agent through the reducing agent supply valve.

In an exhaust emission control apparatus of an internal combustion engine in which combustion is continuously performed at a lean air/fuel ratio, a $NO_X$ catalyst is provided in an exhaust passage of the internal combustion engine for storing $NO_X$ contained in an exhaust gas at a lean air/fuel ratio flowing into the exhaust passage, and reducing the stored $NO_X$ in the presence of a reducing agent in the exhaust gas when the air/fuel ratio of the exhaust gas is lowered, and a reducing agent supply valve is provided in the exhaust passage upstream of the $NO_X$ catalyst, through which the reducing agent is supplied to the $NO_X$ catalyst. In the exhaust emission control apparatus, the flow rate of the exhaust gas is temporarily decreased while supplying the reducing agent through the reducing agent supply valve so as to execute a control of the flow rate of the exhaust gas flowing through the $NO_X$ catalyst in accordance with a value indicating a state of the exhaust gas flowing through the $NO_X$ catalyst. The value is variable upon supply of the reducing agent through the reducing agent supply valve.

According to the embodiment, the value indicating the state of the exhaust gas comprises at least one of an oxygen concentration of the exhaust gas, a temperature of the exhaust gas, a $NO_X$ concentration of the exhaust gas, and a reducing agent concentration of the exhaust gas.

According to another embodiment, the flow rate of the exhaust gas that flows through the $NO_X$ catalyst upon the supply of the reducing agent through the reducing agent supply valve is controlled such that the value indicating the state of the exhaust gas accords with a target value.

According to another embodiment, the flow rate of the exhaust gas that flows through the $NO_X$ catalyst upon the supply of the reducing agent through the reducing agent supply valve is controlled such that the value indicating the state of the exhaust gas becomes one of a maximum value and a minimum value.

According to another embodiment, the flow rate of the exhaust gas that flows through the $NO_X$ catalyst upon the supply of the reducing agent through the reducing agent supply valve is controlled so as to accord a time period elapsing from a predetermined reference timing until the value indicating the state of the exhaust gas reaches a peak upon the supply of the reducing agent through the reducing agent supply valve with a target time period.

According to the embodiment, a quantity of the reducing agent supplied through the reducing agent supply valve is controlled on the basis of the value indicating the state of the exhaust gas at one of a timing before and after the execution of the control of the flow rate of the exhaust gas that flows through the $NO_X$ catalyst upon the supply of the reducing agent through the reducing agent supply valve.

According to the embodiment, the flow rate of the exhaust gas is continuously changed from a timing when the flow rate of the exhaust gas flowing through the $NO_X$ catalyst is decreased until restoration of the flow rate of the exhaust gas.

According to another embodiment, the flow rate of the exhaust gas that flows into the $NO_X$ catalyst is decreased so as to be temporarily held until the flow rate is restored.

In the aforementioned embodiments, the ratio of air supplied into the exhaust passage upstream of a certain point thereof, the combustion chamber and the intake passage to the reducing agent, that is, carbon hydride HC and carbon monoxide CO will be designated as the air/fuel ratio of the exhaust gas.

DETAILED DESCRIPTION OF PREFERRED EMBODIMENTS

Figure 1:
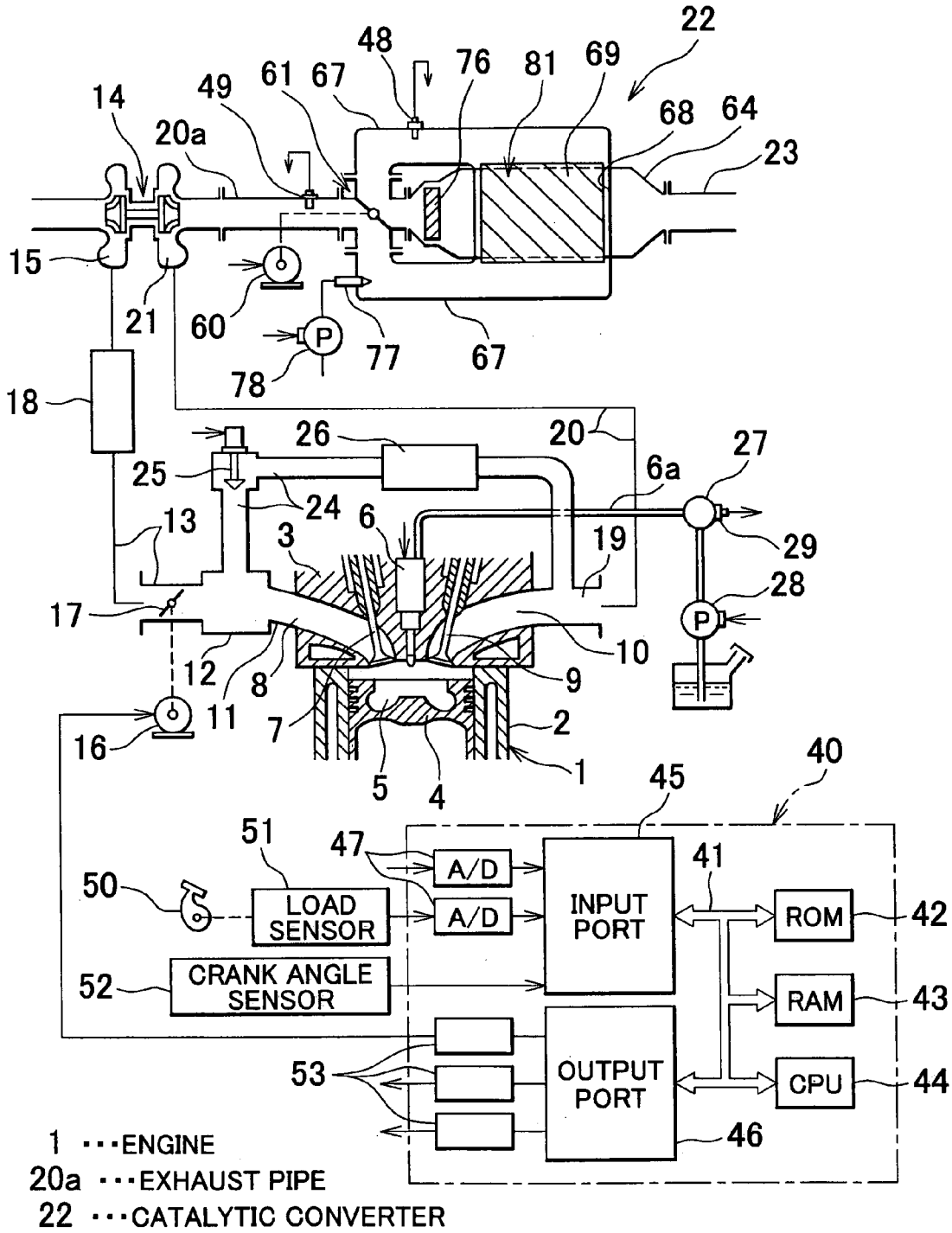
FIG. 1 is a schematic view of an internal combustion engine.

FIG. 1 shows a compression ignition type internal combustion engine to which the invention is applied. A spark ignition type internal combustion engine, however, may be employed.

Referring to FIG. 1, the internal combustion engine includes an engine 1, a cylinder block 2, a cylinder head 3, a piston 4, a combustion chamber 5, an electrically controlled fuel ignition valve 6, an intake valve 7, an intake port 8, an exhaust valve 9, and an exhaust port 10. The intake port 8 is connected to a surge tank 12 via an intake pipe 11. The surge tank 12 is connected to a compressor 15 of an exhaust turbo charger 14 via an intake duct 13. A throttle valve 17 driven by a stepping motor 16 is provided within the intake duct 13 around which a cooling device 18 for cooling the admitted air flowing within the intake duct 13 is provided. In an embodiment as shown in FIG. 1, an engine coolant is introduced into the cooling device 18 such that the intake air is cooled by the engine coolant.

The exhaust port 10 is connected to an exhaust turbine 21 of the exhaust turbo charger 14 via an exhaust manifold 19 and an exhaust pipe 20. An outlet of the exhaust turbine 21 is connected to a catalytic converter 22 via an exhaust pipe 20*a*.

Referring to FIGS. 1 and 2, the catalytic converter 22 includes a selector valve 61 driven by a stepping motor 60. An inlet port 62 of the selector valve 61 is connected to an outlet of the exhaust pipe 20*a*. An outlet port 63 of the selector valve 61 that faces the inlet port 62 is connected to an exhaust discharge pipe 64 of the catalytic converter 22. The selector valve 61 includes a pair of inlet/outlet ports 65, 66 that face with respect to the longitudinal direction of the catalytic converter from the inlet port 62 and the outlet port 63. Each of the inlet/outlet ports 65, 66 is connected to the respective ends of an annular exhaust pipe 67 of the catalytic converter 22. An outlet of the exhaust discharge pipe 64 is connected to the exhaust pipe 23.

The annular exhaust pipe 67 extends through the exhaust discharge pipe 64 in which a filter storage space 68 is formed. A particulate filter 69 for trapping particulate matters within the exhaust gas is stored within the filter storage space 68. Both ends of the particulate filter 69 are designated as 69*a* and 69*b* as shown in FIGS. 2A and 2B.

Figure 2A:
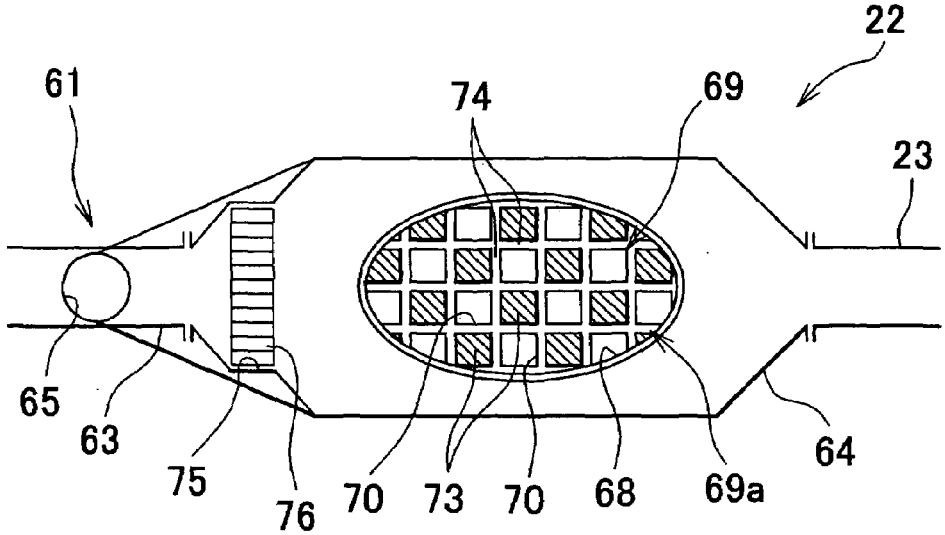
FIGS. 2A and 2B are schematic views each representing a structure of a catalytic converter.
Figure 2B:
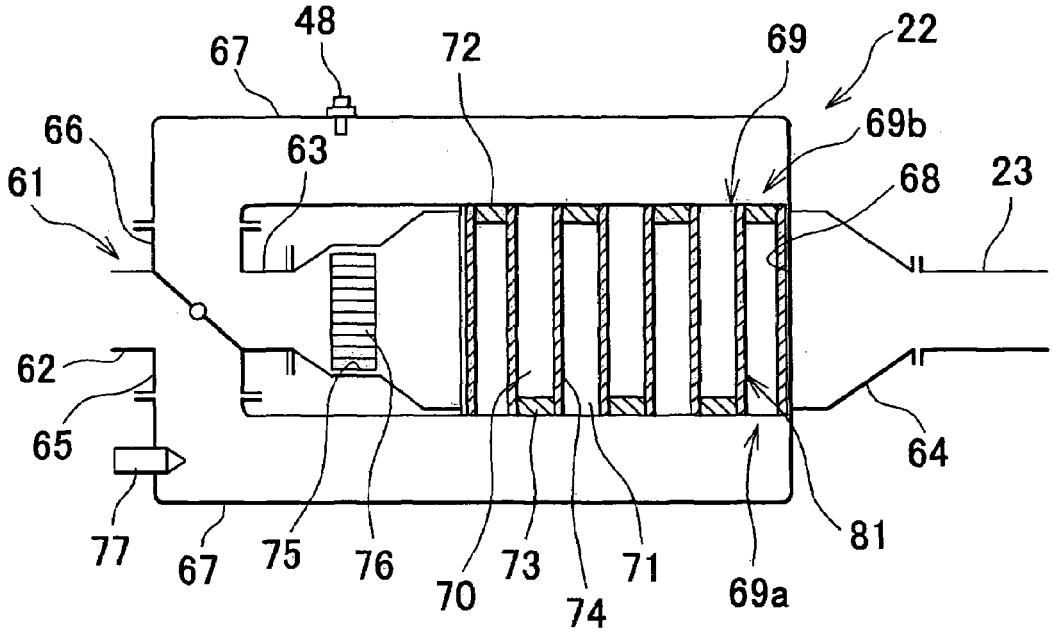

Referring to FIG. 2A showing a partial vertical cross section of the catalytic converter 22 including the one end 69*a* of the particulate filter 69, and FIG. 2B showing a partial transverse cross section of the catalytic converter 22, the particulate filter 69 has a honeycomb structure including a plurality of exhaust gas passages 70, 71 each extending in parallel with each other. The exhaust gas passage 70 has one open end and the other end sealed with a sealing member 72. The exhaust gas passage 71 has one open end and the other end sealed with a sealing member 73. A hatched portion of FIG. 2A represents the sealing member 73. The exhaust gas passages 70 and 71 are alternately arranged by disposing a thin partition 74 formed of a porous material such as a cordierite. In other words, the exhaust gas passage 70 is surrounded with four exhaust gas passages 71, and the exhaust gas passage 71 is surrounded with four exhaust gas passages 70.

A $NO_X$ catalyst 81 is carried on the particulate filter 69 as described later. Meanwhile, a catalytic chamber 75 is provided in a space of the exhaust discharge pipe 64 between the outlet port 63 of the selector valve 61 and the portion where the annular exhaust pipe 67 passes through the exhaust discharge pipe 64. An auxiliary catalyst 76 with oxidizing ability that is carried on the substrate of the honeycomb structure is contained within the catalytic chamber 75.

An electrically controlled reducing agent supply valve 77 is provided in the annular exhaust pipe 67 between the inlet/outlet port 65 of the selector valve 61 and the particulate filter 69 such that the reducing agent is supplied to the particulate filter 69. The reducing agent is supplied from a reducing agent pump 78 to the reducing agent supply valve 77. In this embodiment, the fuel in the internal combustion engine, that is, light oil is employed as the reducing agent. Also, the reducing agent supply valve is not provided in the annular exhaust pipe 67 between the inlet/outlet port 66 and the particulate filter 69.

Referring to FIG. 1, the exhaust manifold 19 is connected to the surge tank 12 via an exhaust gas recirculation (hereinafter referred to as EGR) passage 24 having an electric EGR control valve 25 therein. A cooling device 26 is provided around the EGR passage 24 such that the EGR gas flowing through the EGR passage 24 is cooled. In this embodiment as shown in FIG. 1, the engine cooling water is introduced into the cooling device 26 so as to cool the EGR gas with the engine cooling water.

Each of the fuel injection valves 6 is connected to a fuel reservoir, that is, a common rail 27 via the fuel supply pipe 6*a*. The fuel is supplied into the common rail 27 from the fuel pump 28 that is electrically controlled such that the quantity of the supplied fuel is variable. The fuel supplied into the common rail 27 is further supplied to the fuel injection valve 6 via each of the fuel supply pipes 6*a*. The common rail 27 has a fuel pressure sensor 29 therein so as to detect the fuel pressure within the common rail 27. Accordingly the supply quantity of the fuel pump 28 is controlled such that the fuel pressure within the common rail 27 reaches a target fuel pressure in accordance with the output signal of the fuel pressure sensor 29.

An electronic control unit 40 is formed of a digital computer including a ROM (Read Only Memory) 42, a RAM (Random Access Memory) 43, a CPU (micro-processor) 44, an input port 45 and an output port 46, which are connected with one another via a two-way bus 41. An output signal of the fuel pressure sensor 29 is sent to the input port 45 via an AD converter 47. An exhaust sensor 48 is provided at a position opposite to the reducing agent supply valve 77 with respect to the particulate filter 69 in the annular exhaust pipe 67 so as to detect a state of the exhaust gas that flows therethrough in terms of quantity. An output voltage of the exhaust sensor 48 is sent to the input port 45 via the corresponding AD converter 47. A pressure sensor 49 is provided within the exhaust pipe 20*a* for detecting the pressure therein, that is, the back pressure of the engine. An output voltage of the pressure sensor 49 is sent to the input port 45 via the corresponding AD converter 47. A load sensor 51 for generating an output voltage in proportional to an amount of depressing an accelerator pedal 50 is connected thereto. An output voltage of the load sensor 51 is sent to the input port 45 via the corresponding AD converter 47. A crank angle sensor 52 is connected to the input port 45 for generating an output pulse at every moment where the crank shaft rotates at, for example, 30 degrees.

The output port 46 is connected to the fuel injection valve 6, a stepping motor 16 for driving the throttle valve, the EGR control valve 25, the fuel pump 28, the stepping motor 60 for driving the selector valve, the reducing agent supply valve 77, and the reducing agent pump 78 via the corresponding drive circuit 53. The aforementioned elements are controlled on the basis of output signals from the electronic control unit 40.

Figure 3A:
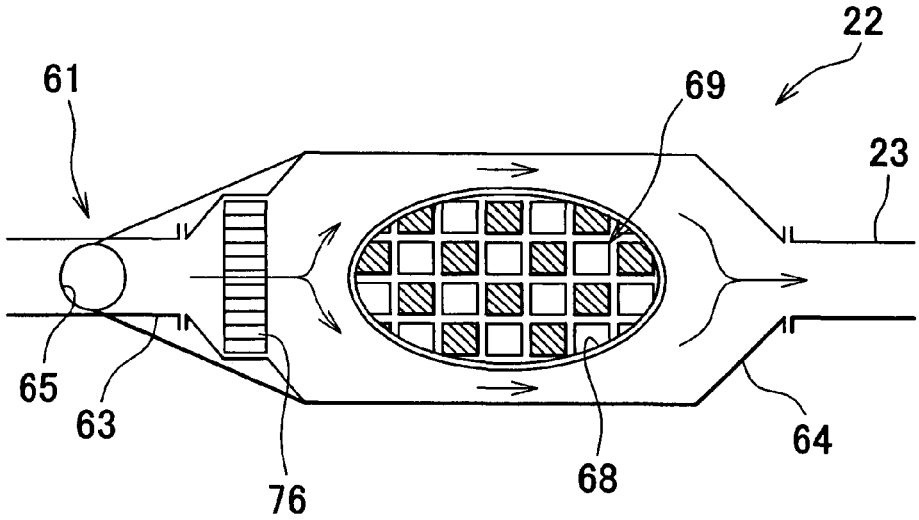
FIGS. 3A and 3B are views each representing a flow of the exhaust gas when a selector valve is in a forward or a reverse flow position.
Figure 3B:
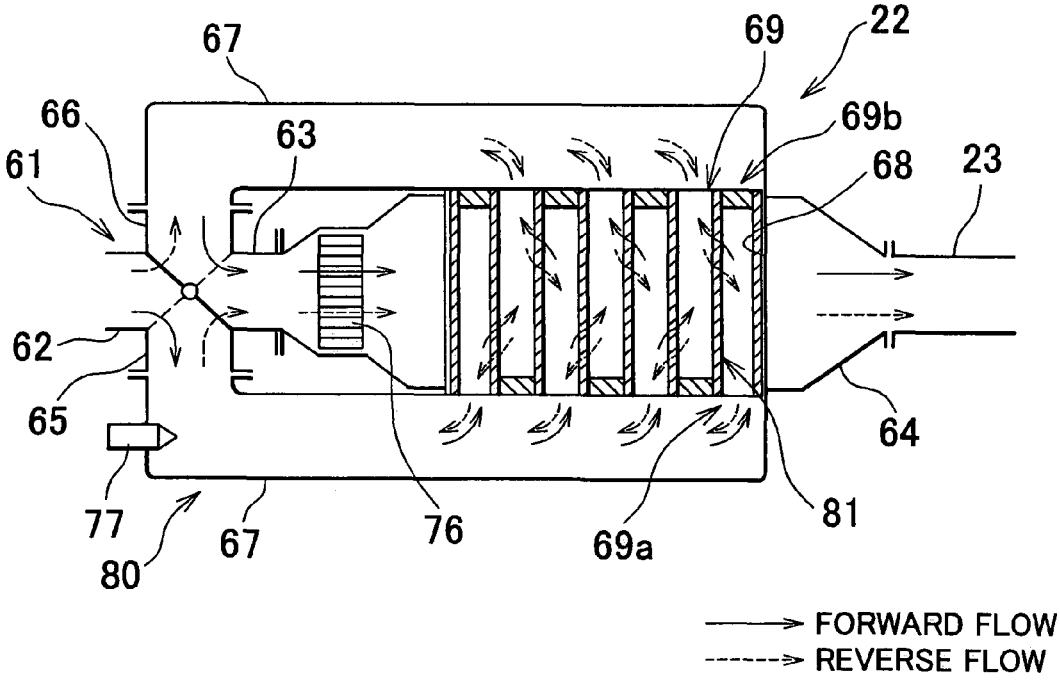

Referring to FIG. 3B, the selector valve 61 is held in the position shown by either the solid line or the dashed line. When the selector valve 61 is held in the position as shown by the solid line in FIG. 3B, the inlet port 62 is disconnected from the outlet port 63 and the inlet/outlet port 66, while being communicated with the inlet/outlet port 65. The outlet port 63 is communicated with the inlet/outlet port 66 via the selector valve 61. Accordingly as shown by the solid arrow in FIG. 3B, all the exhaust gas flowing through the exhaust pipe 20*a* flows into the annular exhaust pipe 67 via the inlet port 62, and then the inlet/outlet port 65 . After the exhaust gas passes through the particulate filter 69, it is discharged to the exhaust discharge pipe 64 via the inlet/outlet port 66 and the outlet port 63 sequentially.

When the selector valve 61 is held in the position as shown by the dashed line in FIG. 3B, communication between the inlet port 62 and the outlet port 63, the inlet/outlet port 65 is interrupted, and the inlet port 62 is communicated with the inlet/outlet port 66. The outlet port 63 is communicated with the inlet/outlet port 65 via the selector valve 61. Accordingly as shown by the dashed arrow in FIG. 3B, all the exhaust gas flowing through the exhaust pipe 20*a* flows into the annular exhaust pipe 67 via the inlet port 62 and the inlet/outlet port 66. After the exhaust gas passes through the particulate filter 69, it is discharged to the exhaust discharge pipe 64 via the inlet/outlet port 65 and the outlet port 63 sequentially.

The direction of the exhaust gas that flows through the annular exhaust pipe 67 may be switched by changing the position of the selector valve 61. In other words, the direction of the exhaust gas flowing through the $NO_X$ catalyst 81 from one end surface to the other end surface thereof may be reversed. The exhaust gas flow shown by the solid line in FIG. 3B will be referred to as a forward flow, and shown by the dashed line will be referred to as a reverse flow, respectively. The position of the selector valve 61 shown by the solid line in FIG. 3B will be referred to as a forward flow position, and shown by the dashed line will be referred to as a reverse flow position, respectively.

Referring to FIGS. 3A and 3B, the exhaust gas discharged to the exhaust discharge pipe 64 via the outlet port 66 passes through the catalyst 76, and further flows along the outer peripheral surface of the annular exhaust pipe 67. The exhaust gas is finally discharged into the exhaust pipe 23.

In case of the forward flow, the exhaust gas flows into the particulate filter 69 via one end surface 69*a*, and is discharged from the particulate filter 69 via the other end surface 69*b*. Then the exhaust gas flows into the exhaust gas passage 70 that opens to the end surface 69*a*, and is discharged into the adjacent exhaust gas passage 71 through the surrounding partition 74. Meanwhile, in case of the reverse flow, the exhaust gas flows into the particulate filter 69 via the one end surface 69*b*, and is discharged from the particulate filter 69 via the end surface 69*a*. Then the exhaust gas flows into the exhaust gas passage 71 that opens to the other end surface 69*b*, and is discharged into the adjacent exhaust gas passage 70 through the surrounding partition 74.

Figure 4:
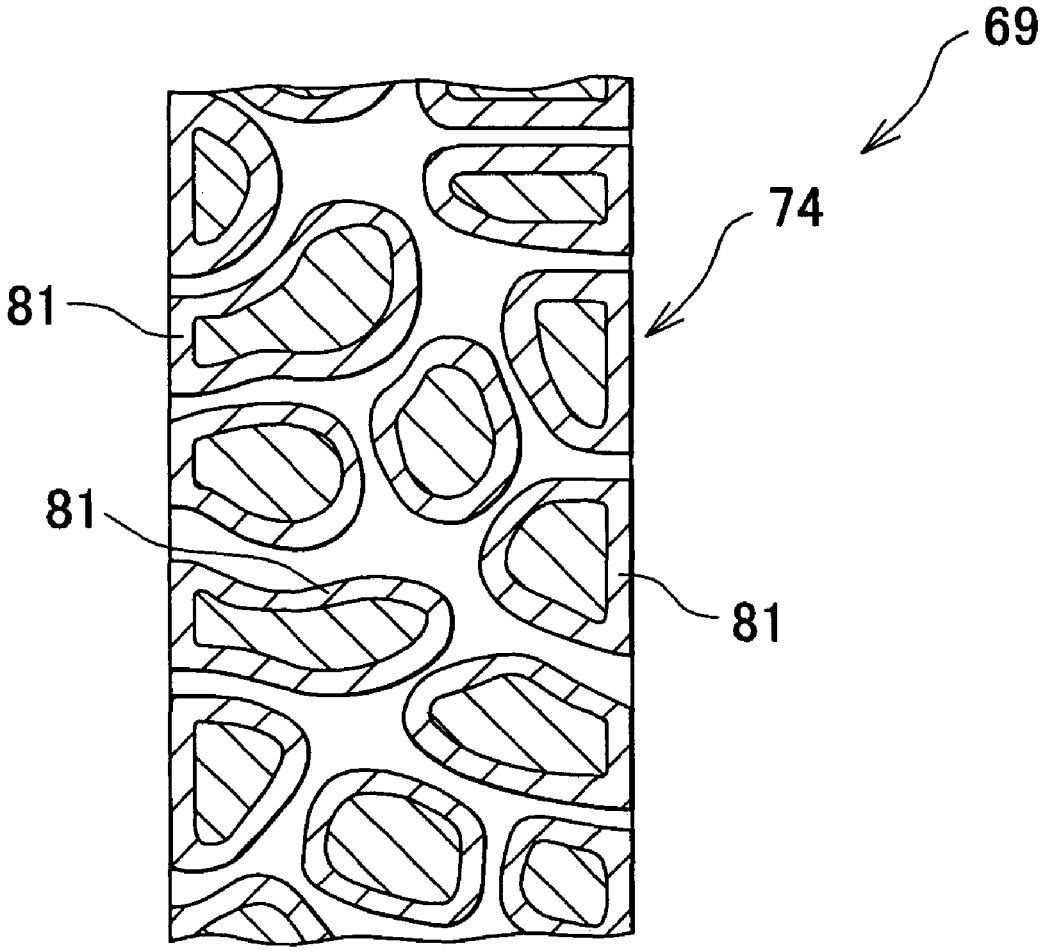
FIG. 4 is a partial enlarged cross sectional view of a partition of a particulate filter.

As shown in FIG. 4, the $NO_X$ catalyst 81 is carried on the partition 74 of the particulate filter 69, that is, both side surfaces and porous inner wall surface of the partition 74, for example. The $NO_X$ catalyst 81 includes an alumina substrate which carries at least one element selected from alkaline metal such as kalium K, natrium Na, lithium Li, and cesium Cs, alkaline earth such as barium Ba, and calcium Ca, and rare earths such as lanthanum La, and yttrium Y, and a rare metal such as platinum Pt, palladium Pd, rhodium Rh and irridium Ir.

The $NO_X$ catalyst stores $NO_X$ when the mean air/fuel ratio of the introduced exhaust gas is lean, and reduces the stored $NO_X$ such that its quantity is reduced in the presence of the reducing agent of the exhaust gas in response to the decrease in the air/fuel ratio of the exhaust gas.

The specific mechanism of the $NO_X$ catalyst function for storing and reducing the $NO_X$ has not been clarified yet. However, such mechanism that has been generally assumed will be briefly described in the case where Pt and Ba are carried on the substrate as below.

When the air/fuel ratio of the exhaust gas flowing into the $NO_X$ catalyst becomes considerably leaner than the theoretical value, the oxygen concentration of the exhaust gas is increased to the greater degree, and oxygen $O_2$ adheres to the surface of Pt in the form of $O_2^-$ or $O^{2-}$. The NO contained in the introduced exhaust gas adheres to the surface of Pt to react with $O_2^-$ or $O^{2-}$ thereon so as to become $NO_2$ ($NO+O_2 \rightarrow NO_2+O^*$ where $O^*$ is an active oxygen). A part of the generated $NO_2$ is further oxidized on Pt so as to be absorbed by the $NO_X$ catalyst. The absorbed $NO_2$ reacts with oxide barium BaO and is diffused within the $NO_X$ catalyst in the form of nitric acid ions $NO_3^-$. The $NO_X$ is stored in the $NO_X$ catalyst in the aforementioned manner.

When the air/fuel ratio of the exhaust gas introduced into the $NO_X$ catalyst has a value indicating the rich or theoretical state, the oxygen concentration of the exhaust gas decreases to reduce the quantity of generated $NO_2$. This may reverse the reaction, that is, $NO_3^- \rightarrow NO+2O^*$, and thus, the nitric acid ions $NO_3^-$ contained in the $NO_X$ catalyst is released therefrom in the form of NO. The released $NO_X$ is then reduced through reaction with the reducing agent contained in the exhaust gas, for example HC, CO. When the $NO_X$ no longer exists on the surface of Pt, it is released from the $NO_X$ catalyst one after another. As a result, the quantity of the $NO_X$ stored in the $NO_X$ catalyst is gradually decreased.

The $NO_X$ catalyst may be structured to store $NO_X$ without forming the nitrate salt, and to reduce the $NO_X$ without being released. It is possible to consider the $NO_X$ catalyst as the catalyst that generates active oxygen upon storage and release of the $NO_X$.

The auxiliary catalyst 76 of the embodiment may be formed as a rare metal catalyst including the rare metal such as platinum Pt without employing the alkaline metal, alkaline earth, nor rare earths. The auxiliary catalyst 76, however, may be formed as the $NO_X$ catalyst as described above.

The particulate filter 69 is disposed in substantially the center of the annular exhaust pipe 67. That is, the distance between the inlet port 62 of the selector valve 61 and the particulate filter 69, and the distance between the outlet port 63 and the particulate filter 69 hardly change upon setting of the selector valve 61 either in the forward flow position or in the reverse flow position. This shows that a certain state of the particulate filter 69 such as the temperature is hardly influenced by the position of the selector valve 61 either in the forward flow position or in the reverse flow position. Therefore the specific control with respect to the position of the selector valve 61 is not required.

Figure 5:
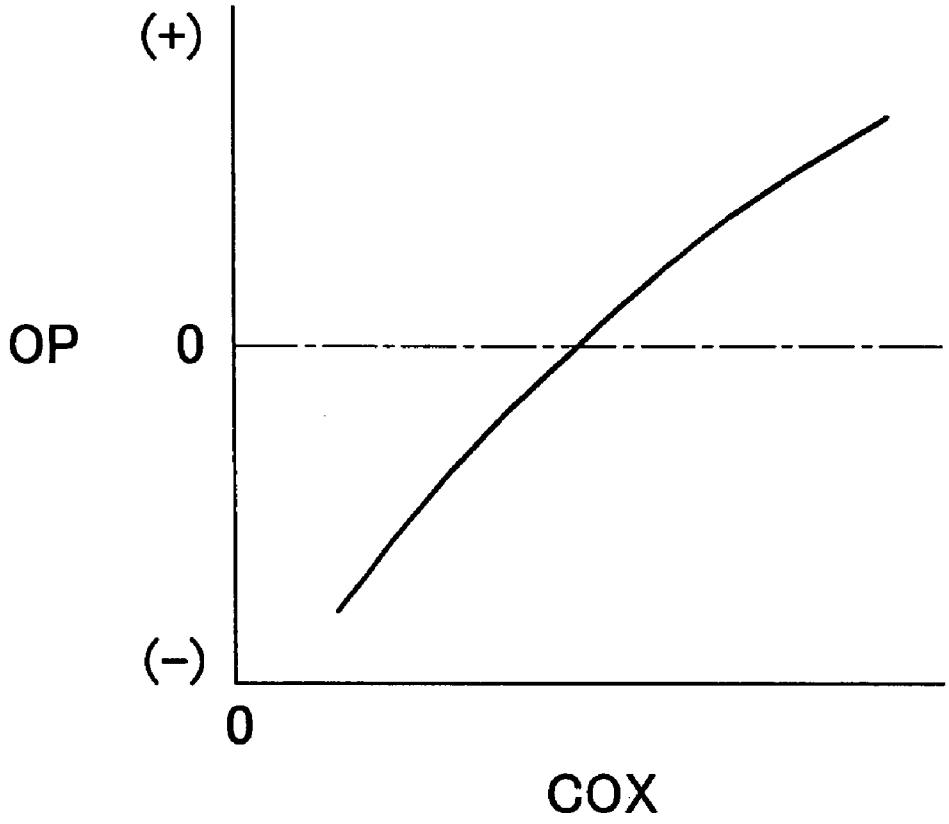
FIG. 5 is a graph representing an output of an $O_2$ sensor.

In the embodiment of the invention, the exhaust sensor 48 is formed as an oxygen sensor that generates the output voltage in proportional to the concentration COX of oxygen contained in the exhaust gas. When the selector valve 61 is in the forward flow position, the exhaust sensor or the oxygen sensor 48 detects the concentration of oxygen contained in the exhaust gas discharged from the $NO_X$ catalyst 81. When the selector valve 61 is in the reverse flow position, the oxygen sensor 48 detects the concentration of oxygen contained in the exhaust gas that flows into the $NO_X$ catalyst 81. An example of outputs OP of the oxygen sensor 48 with respect to the oxygen concentration COX is represented by the graph shown in FIG. 5. The outputs OP of the oxygen sensor 48 represent the air/fuel ratio of the exhaust gas that is discharged from the $NO_X$ catalyst 81. Assuming that the air/fuel ratio of the exhaust gas discharged from the $NO_X$ catalyst 81 is the theoretical air/fuel ratio when the output OP of the oxygen sensor 48 becomes zero, if the OP takes a positive value, the air/fuel ratio of the exhaust gas is considered as being lean. Meanwhile, if the OP takes a negative value, the air/fuel ratio is considered as being rich.

The exhaust gas passes through the particulate filter 69 irrespective of the position of the selector valve 61 either in the forward or the reverse flow position. In the internal combustion engine shown in FIG. 1, combustion is continuously performed in the fuel lean state. Accordingly the air/fuel ratio of the exhaust gas that passes through the particulate filter 69 is held in the lean state. As a result, the $NO_X$ in the exhaust gas is stored in the $NO_X$ catalyst 81 on the particulate filter 69.

The quantity of the $NO_X$ stored in the $NO_X$ catalyst 81 gradually increases as time passes. The embodiment is structured to perform control for decreasing the stored $NO_X$ when the stored $NO_X$ quantity exceeds an allowable value by temporarily supplying the reducing agent to the $NO_X$ catalyst 81 through the reducing agent supply valve 77 so as to reduce $NO_X$.

The control routine for reducing quantity of stored $NO_X$ shown in FIG. 6 will be described referring to FIG. 7. In step 200, the $NO_X$ quantity QN stored in the $NO_X$ catalyst 81 is calculated. The $NO_X$ quantity QN is obtained using the sum of the quantity of the $NO_X$ that flows into the $NO_X$ catalyst 81 per unit of time at the lean air/fuel ratio of the exhaust gas flowing into the $NO_X$ catalyst 81. Then in step 201, it is determined whether the calculated $NO_X$ quantity QN is larger than an allowable quantity QN1. If NO is obtained in step 201, that is, the QN is equal to or smaller than the QN1, the routine ends. If YES is obtained in step 201, that is, the QN is larger than the QN1, the process proceeds to step 202 where the position of the selector valve 61 is changed from the forward flow position to the reverse flow position or vice versa. The reducing agent is then injected through the reducing agent supply valve 77 only once.

Figure 7:
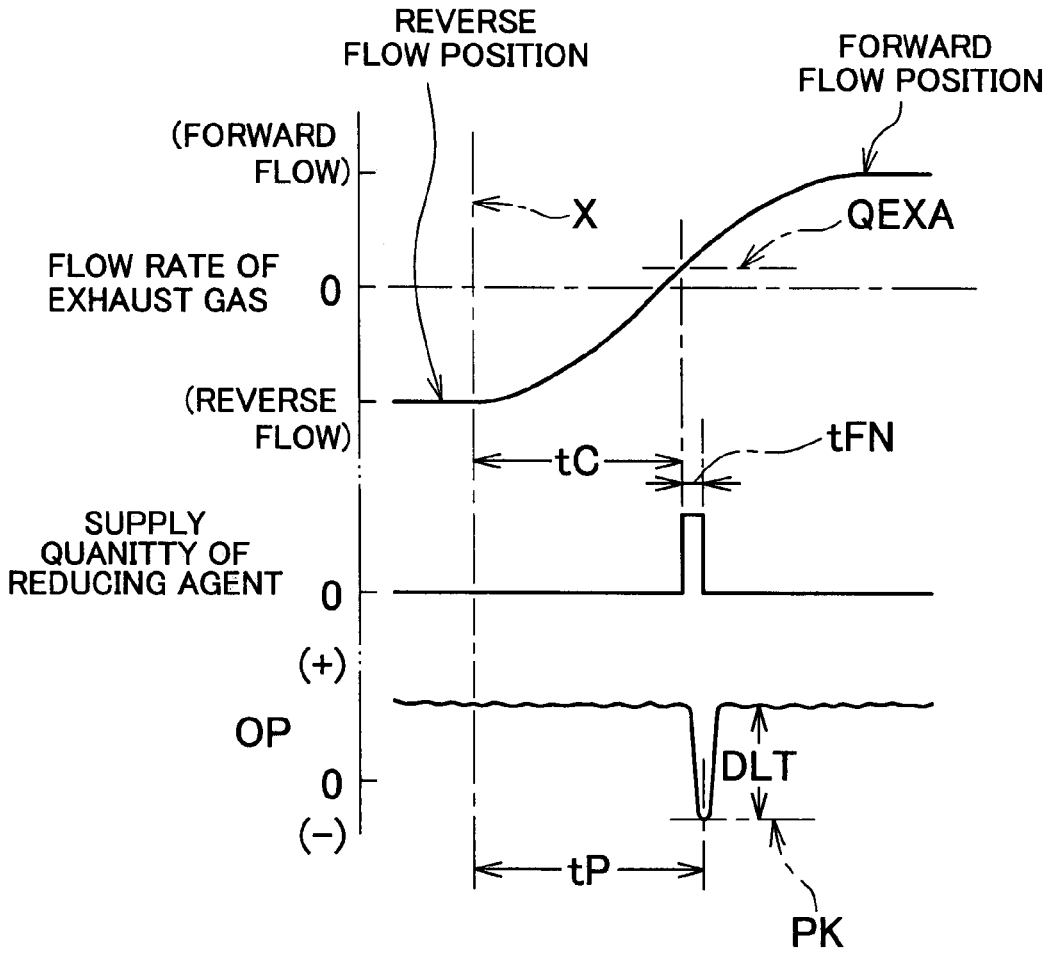
FIG. 7 is a timing chart representing the control for decreasing the stored $NO_X$.

If the quantity of $NO_X$ stored in the $NO_X$ catalyst 81 exceeds the allowable quantity, a signal instructing to change the position of the selector valve 61, for example, from the reverse flow position to the forward flow position is generated at a timing as shown by X in FIG. 7. In response to the signal, the position of the selector valve 61 is changed from the reverse to the forward flow position. Upon change in the position of the selector valve 61 from the reverse to the forward flow position, the inlet port 62 is temporarily connected directly to the outlet port 63. Accordingly upon change in the position of the selector valve 61 from the reverse to the forward flow position, the quantity of the exhaust gas flowing through the $NO_X$ catalyst 81 in the reverse direction gradually decreases as shown in FIG. 7. Meanwhile, the quantity of the exhaust gas that bypasses the $NO_X$ catalyst 81 gradually increases. Once the quantity of the exhaust gas flowing through the $NO_X$ catalyst 81 becomes zero, the quantity of the exhaust gas flowing through the $NO_X$ catalyst 81 in the forward direction gradually increases, and the quantity of the exhaust gas that bypasses the $NO_X$ catalyst 81 gradually decreases. That is, change in the position of the selector valve 61 from the forward to the reverse flow position or vice verse, the quantity of the exhaust gas flowing through the $NO_X$ catalyst 81 in the forward direction may be temporarily decreased. Supply of the reducing agent through the reducing agent supply valve 77 at the aforementioned timing makes it possible to decrease the quantity of the reducing agent required to bring the air/fuel ratio of the exhaust gas flowing into the $NO_X$ catalyst 81 into rich. The space velocity of the exhaust gas within the $NO_X$ catalyst 81 is decreased at the above moment. As a result, the time period when the reducing agent is stored within the $NO_X$ catalyst 81 is increased. This makes it possible to efficiently use the reducing agent. The reducing agent supplied to the $NO_X$ catalyst 81 is diffused all over thereof in the forward flow direction.

In the embodiment, the reducing agent is supplied for the period of tFN upon elapse of tC from a predetermined reference timing such that the exhaust gas flows through the $NO_X$ catalyst 81 by a slight amount, that is, QEXA in the forward direction. The amount QEXA is considered as an optimum flow rate of the exhaust gas for reducing the $NO_X$ as well as decreasing the stored $NO_X$ quantity. The elapsing time tC is preliminarily set such that the flow rate of the exhaust gas flowing through the $NO_X$ catalyst 81 becomes the optimum amount QEXA upon supply of the reducing agent through the reducing agent supply valve 77. The time tC elapsing when the position of the selector valve 61 is changed from the forward to the reverse flow position is slightly different from the time tC elapsing when the position of the selector valve 61 is changed from the reverse to the forward flow position. However, it is assumed that such time tC is substantially equivalent, and thus, will be collectively utilized hereinafter.

The aforementioned predetermined reference time may be determined in an arbitrary manner. In this embodiment, the reference time is set to the one from which the signal is generated to instruct the change in the position of the selector valve 61 from the forward to the reverse flow position or vice versa as shown by the arrow X shown in FIG. 7.

The exhaust gas contains sulfur in the form of $SO_X$. The $NO_X$ catalyst 81 stores not only $NO_X$ but also $SO_X$. The $SO_X$ is stored within the $NO_X$ catalyst 81 in the same manner as in the case of $NO_X$. Supposing that the catalyst carries Pt and Ba on the substrate, oxygen $O_2$ adheres to the surface of Pt in the form of $O_2^-$ or $O^{2-}$ at the lean air/fuel ratio of the exhaust gas flowing into the $NO_X$ catalyst 81. The $SO_2$ contained in the exhaust gas adheres to the surface of Pt on which $SO_2$ reacts with $O_2^-$ or $O^{2-}$ into $SO_3$. The resultant $SO_3$ is further oxidized on the Pt, and absorbed within the $NO_X$ catalyst 81 so as to be bound with the barium oxide BaO. Accordingly, the resultant $SO_4^-$ is diffused within the $NO_X$ catalyst 81. The sulfuric acid ion $SO_4^-$ is bound with barium ion $Ba^+$ for further forming nitric acid salt $BaSO_4$ The nitric acid salt $BaSO_4$ is hardly decomposed, and the quantity of the nitric acid salt $BaSO_4$ within the $NO_X$ catalyst 81 does not decrease even if the air/fuel ratio of the exhaust gas flowing through the $NO_X$ catalyst 81 is brought into the rich state. In this way, the nitric acid salt $BaSO_4$ within the $NO_X$ catalyst 81 increases as time elapses. As a result, the quantity of the $NO_X$ that can be stored within the $NO_X$ catalyst may be decreased.

In the case where the mean air/fuel ratio of the exhaust gas flowing into the $NO_X$ catalyst 81 is controlled to the theoretical air/fuel ratio or the rich state while holding the temperature of the $NO_X$ catalyst 81 at 550° C. or higher, the sulfate $BaSO_4$ within the $NO_X$ catalyst 81 is decomposed and released therefrom in the form of $SO_3$. The released $SO_3$ reacts with HC, CO as the reducing agent contained in the exhaust gas so as to be reduced to $SO_2$. The $SO_X$ stored in the $NO_X$ catalyst 81 in the form of the sulfate $BaSO_4$ is gradually decreased. Accordingly, the $SO_X$ is not released from the $NO_X$ catalyst 81 in the form of $SO_3$.

In the embodiment, if the quantity of the $SO_X$ stored in the $NO_X$ catalyst 81 exceeds the allowable value, the control of reducing the stored $SO_X$ is executed by holding the temperature of the $NO_X$ catalyst 81 at a lower limit temperature for decreasing the $SO_X$ quantity, for example, 550° C. or higher while holding the mean air/fuel ratio of the exhaust gas flowing into the $NO_X$ catalyst 81 at the theoretical air/fuel ratio or in the rich state.

A control routine of decreasing the stored $SO_X$ shown in FIG. 8 will be described referring to FIGS. 9 and 10. In step 210, the quantity of $SO_X$ stored in the $NO_X$ catalyst 81, that is, QS is calculated. The QS may be obtained on the basis of the sum of the quantity of the fuel supplied through the fuel injection valve, and the reducing agent (fuel) supplied through the reducing agent supply valve 77. Then in step 211, it is determined whether the calculated QS is larger than an allowable quantity QS1. If NO is obtained, that is, $QS \leqq QS1$, the control routine ends. If YES is obtained, that is, $QS > QS1$, the process proceeds to step 212. In step 212, as shown in FIG. 9, the selector valve 61 is set to the weak forward flow position from the forward flow position to be held as shown in FIG. 10 such that the reducing agent is supplied through the reducing agent supply valve 77.

Figure 10:
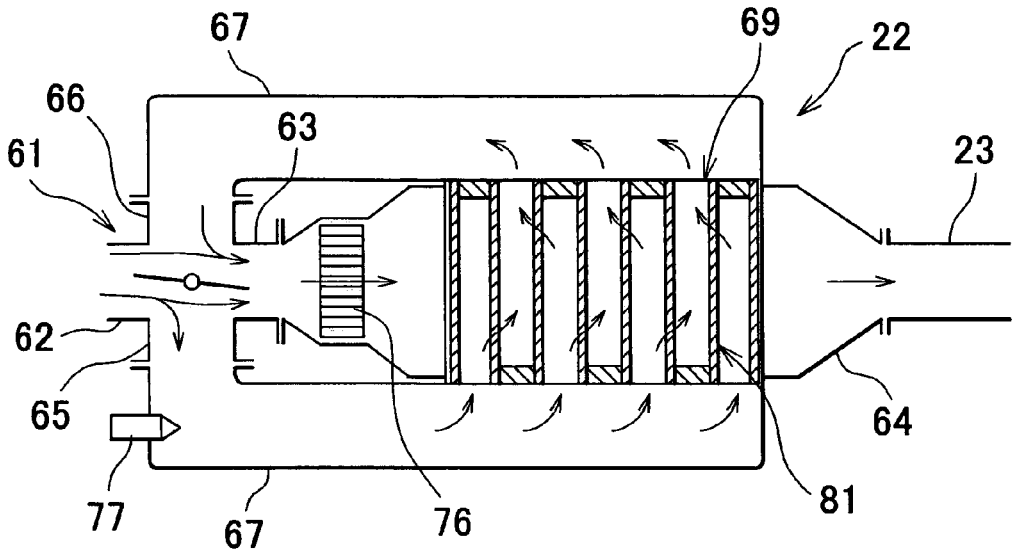
FIG. 10 is a view representing a flow of the exhaust gas when a selector valve locates in a weak forward flow position.

In the case where the selector valve 61 is held in the weak forward flow position, a part of the exhaust gas flowing through the exhaust valve 20*a* enters into the annular exhaust pipe 67 via the inlet/outlet port 65 as shown by an arrow in FIG. 10. The exhaust gas then flows in the forward direction through the $NO_X$ catalyst 81. The rest of the exhaust gas directly flows into the exhaust discharge pipe 64 from the inlet port 62 via the outlet port 63, that is, bypasses the $NO_X$ catalyst 81 to flow into the auxiliary catalyst 76. In the aforementioned case, the reducing agent is supplied to the $NO_X$ catalyst 81 while decreasing the flow rate of the exhaust gas flowing into the $NO_X$ catalyst 81.

Under the control of reducing the stored $SO_X$, the reducing agent is supplied for a time period of tFS. The time period tFS is set as a time period required for holding the temperature of the $NO_X$ catalyst 81 to be equal to or higher than the temperature TNS required for reducing the $SO_X$ quantity while holding the mean air/fuel ratio of the exhaust gas flowing into the $NO_X$ catalyst 81 in slightly richer state, for example.

Figure 8:
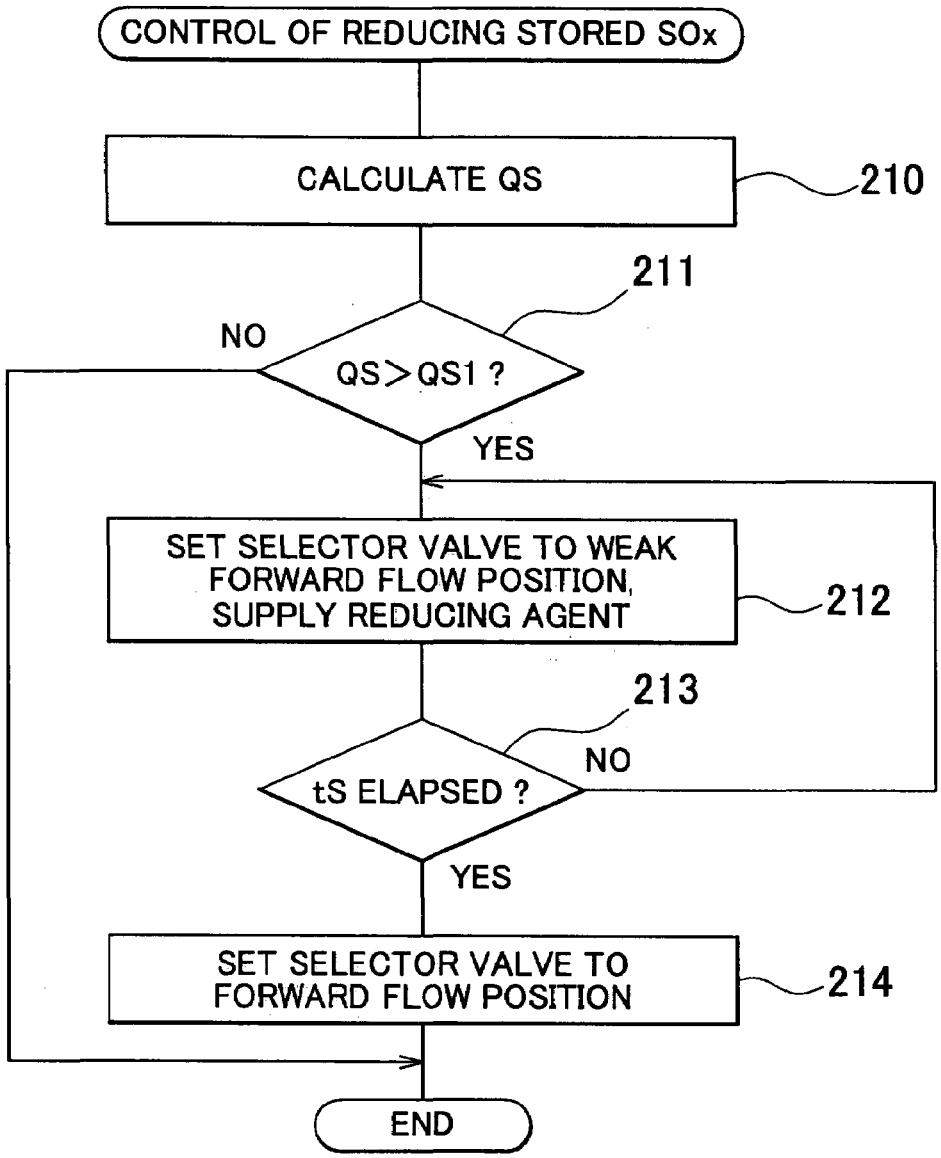
FIG. 8 is a flowchart representing a control routine for decreasing stored $SO_X$.
Figure 9:
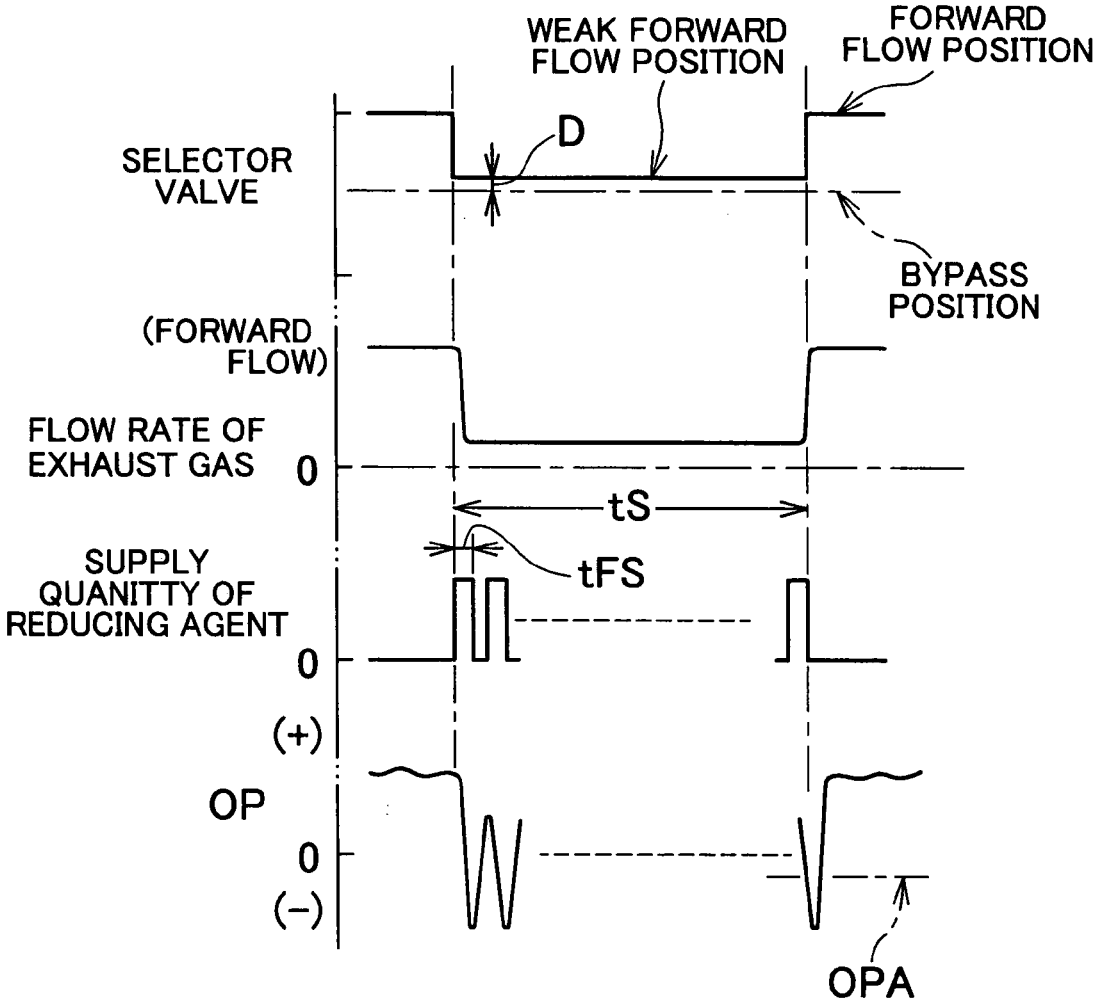
FIG. 9 is a timing chart representing the control for decreasing the stored $SO_X$.

Then in step 213 of the flowchart in FIG. 8, it is determined whether the time tS has been elapsed from supply of the reducing agent in the state where the selector valve 61 is held in the weak forward flow position. The time tS is set to a predetermined time required to reduce the quantity of $SO_X$ stored in the $NO_X$ catalyst 81 to almost zero. If NO is obtained in step 213, that is, the time tS has not been elapsed, the process returns to step 212 where the reducing agent is repeatedly supplied while holding the selector valve 61 in the weak forward flow position. If YES is obtained in step 213, that is, the time tS has been elapsed, the process proceeds to step 214 where the position of the selector valve 61 is changed to, for example, the forward flow position. This indicates that the control of reducing the stored $SO_X$ has been completed.

When the selector valve 61 is held in the bypass position as shown in FIG. 9, all the exhaust gas flowing through the exhaust pipe 20*a* directly flows into the exhaust discharge pipe 64 from the inlet port 62 via the outlet port 63. That is, the exhaust gas bypasses the $NO_X$ catalyst 81 and the particulate filter 69 without flowing therethrough. The flow passage of the exhaust gas from the inlet port 62 to the outlet port 63 of the selector valve 61 serves as the bypass passage through which the exhaust gas bypasses the particulate filter 69.

Referring to the exemplary timing chart of FIG. 9, the "OPA" represents a mean value of outputs OP of the oxygen sensor 48. According to the timing chart in FIG. 9, the OPA under the control of reducing the stored $SO_X$ takes a negative value. In FIG. 9, the "D" represents an opening degree or opening position of the selector valve 61. If the selector valve 61 is in the bypass position, the D takes zero. As the selector valve 61 approaches the forward flow position, the opening degree D increases. Accordingly the flow rate of the exhaust gas flowing through the $NO_X$ catalyst 81 increases as the opening degree D becomes large. In the embodiment, the opening degree D representing the weak forward flow position is set such that the flow rate of the exhaust gas flowing through the $NO_X$ catalyst 81 is held at the value optimum for executing appropriate control of reducing the stored $SO_X$.

In the control of reducing the stored $SO_X$ of the embodiment, the flow rate of the exhaust gas flowing through the $NO_X$ catalyst is decreased to an optimum value which is temporarily held, and further resumed to the original flow rate. Meanwhile in the control of reducing the stored $NO_X$ of the embodiment, the flow rate of the exhaust gas flowing into the $NO_X$ catalyst 81 is decreased, and then continuously adjusted until it resumes the original flow rate. In the control of reducing the stored $SO_X$, the reducing agent may be supplied not only when the position of the selector valve 61 is repeatedly changed from the forward to the reverse flow position or vice versa alternately, but also when the position of the selector valve 61 is changed from the forward to the reverse flow position or vice versa.

The particulate matter mainly formed of a carbon contained in the exhaust gas is trapped on the particulate filter 69. When the exhaust gas flows in the forward direction, the particulate matter is trapped on the side surface and within the pore of the partition 74 at the side of the exhaust gas passage 70. When the exhaust gas flows in the reverse direction, the particulate matter is trapped on the side surface and within the pore of the partition 74 at the exhaust gas passage 71. In the internal combustion engine shown in FIG. 1, combustion is continuously performed at the lean air/fuel ratio. As the $NO_X$ catalyst 81 has an oxidizing ability, the particulate matter is oxidized on the particulate filter 69 and eliminated if the temperature of the particulate filter 69 is held at the temperature at which the particulate matter can be oxidized, for example, 250° C. or higher.

According to the $NO_X$ storage/reducing function of the $NO_X$ catalyst 81, the active oxygen is generated upon storage and release of the $NO_X$ through the $NO_X$ catalyst 81. The resultant active oxygen has higher activity compared with oxygen $O_2$ that functions in quickly oxidizing the particulate matter trapped on the particulate filter 69. When the $NO_X$ catalyst 81 is carried on the particulate filter 69, the particulate matter trapped on the particulate filter 69 is oxidized regardless of the state of the air/fuel ratio of the exhaust gas flowing through the particulate filter 69, i.e., fuel rich or fuel lean. In this way, the particulate matter is continuously oxidized.

In the case where the temperature of the particulate filter 69 is no longer held at the temperature for oxidizing the particulate matter, or the quantity of the particulate matter entering into the particulate filter 69 per unit of time becomes substantially large, the quantity of the particulate matter trapped on the particulate filter 69 gradually increases. This may increase the pressure loss of the particulate filter 69. In the embodiment, if the quantity of the trapped particulate matter exceeds the allowable value, the control of oxidizing particulate matter is executed. In this control, the temperature of the particulate filter 69 is increased to the temperature TNP required to oxidize the particulate matter, for example, 600° C. or higher so as to be held while holding the lean air/fuel ratio of the exhaust gas flowing through the particulate filter 69. Under the aforementioned control, the particulate matter trapped on the particulate filter 69 is ignited and burnt. The particulate matter, thus, is removed. In the embodiment as shown in FIG. 1, if the back pressure of the engine detected by the pressure sensor exceeds the allowable value in the case where the selector valve 61 is held in the forward or reverse flow position, it is determined that the quantity of the trapped particulate matter exceeds the allowable quantity.

Figure 11:
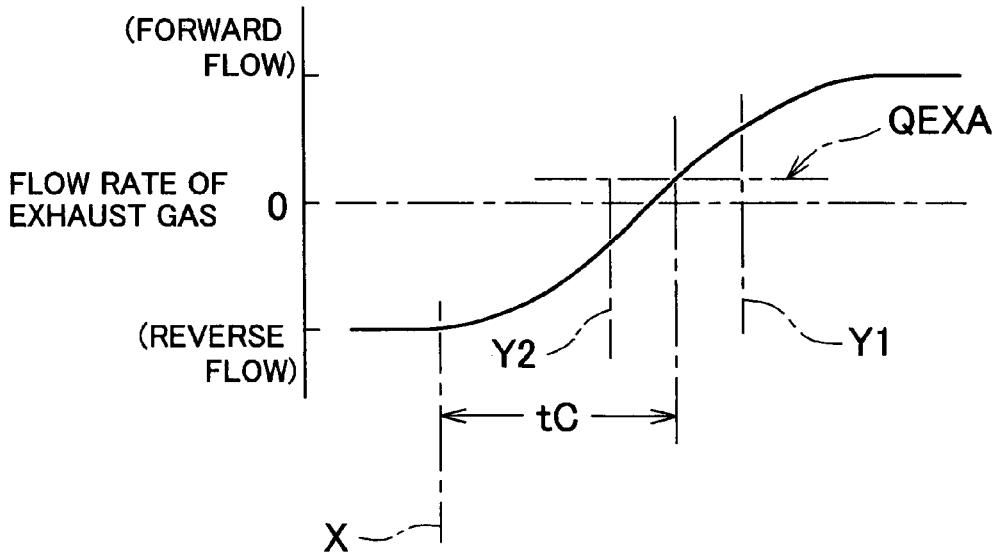
FIG. 11 is a graph representing the exhaust gas quantity upon selection of the selector valve.

In the control of reducing the stored $NO_X$ of the embodiment, the reducing agent is supplied through the reducing agent supply valve 77 upon elapse of the time tC from the timing X at which the signal is output for changing the position of the selector valve 61. Actually, however, each performance of the reducing agent supply valve varies, and the actual elapsing time does not always accord with the normal elapsing time. If the time elapsing from the timing X until supply of the reducing agent is longer than the normal elapsing time, the flow rate of the exhaust gas upon supply of the reducing agent becomes higher than the optimum value QEXA. As a result, the air/fuel ratio of the exhaust gas flowing into the $NO_X$ catalyst 81 cannot be brought into the rich state, failing to sufficiently decrease the space velocity of the exhaust gas within the $NO_X$ catalyst 81. If the time period elapsing from the timing X until the supply of the reducing agent as shown by Y2 of the exemplary chart of FIG. 11 is shorter than the normal elapsing time, the reducing agent will be supplied when the exhaust gas flows in the reverse direction. Accordingly, the reducing agent fails to reach the $NO_X$ catalyst 81.

Figure 12:
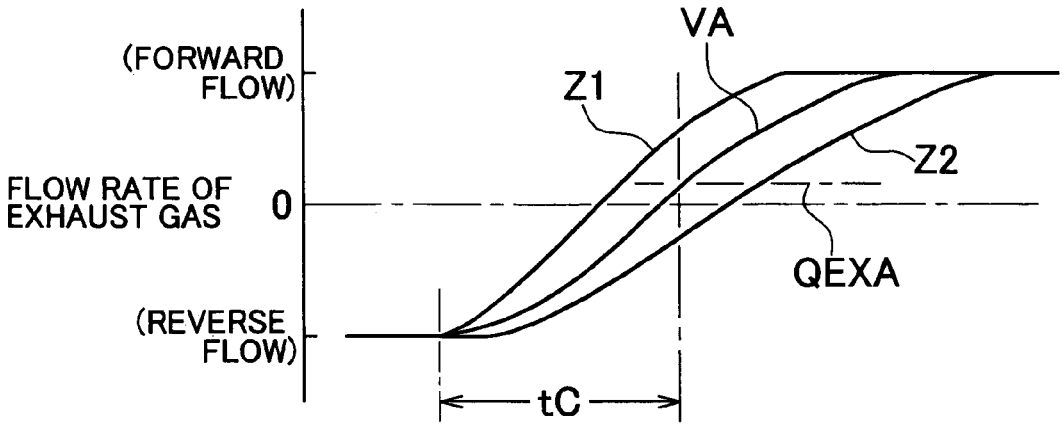
FIG. 12 is a graph representing the exhaust gas quantity upon selection of the selector valve.

Actually, each performance of the selector valve 61 or the stepping motor 60 for driving the selector valve 61 varies. This may deviate the actual flow rate of the exhaust gas during supply of the reducing agent from the optimum value QEXA even if the time elapsing from the timing X until the actual supply of the reducing agent is held to the normal elapsing time. If the speed for selecting the position of the selector valve 61 is higher than the normal speed VA as shown by Z1 in an exemplary chart of FIG. 12, the flow rate of the exhaust gas upon supply of the reducing agent becomes higher than the optimum flow rate QEXA as in the case of long elapsing time as described above. If the speed for selecting the position of the selector valve 61 is lower than the normal selection speed VA as shown by Z2 of the timing chart of FIG. 12, the exhaust gas flows in the reverse direction during supply of the reducing agent as in the case of the short elapsing time.

The selector valve 61 is held in the weak forward flow position under the control of reducing the stored $SO_X$. In this case, however, the opening degree D of the selector valve 61 at this time may not accord with the normal opening degree. If the actual opening degree of the selector valve 61 is larger than the normal opening degree, the flow rate of the exhaust gas upon supply of the reducing agent becomes higher than the optimum flow rate QEXA. If the actual opening degree is smaller than the normal driving degree, the flow rate of the exhaust gas upon supply of the reducing agent becomes lower than the QEXA.

In the embodiment, the control of correcting the flow rate of the exhaust gas is executed so as to hold the flow rate of the exhaust gas flowing through the $NO_X$ catalyst 81 in the forward direction upon supply of the reducing agent at the optimum value.

The oxygen concentration of the exhaust gas discharged from the $NO_X$ catalyst 81 varies upon supply of the reducing agent to the $NO_X$ catalyst 81. In the timing chart shown in FIG. 7, when the time tP elapses from the reference timing, for example, the timing X at which the signal for changing the position of the selector valve 61, the output OP of the oxygen sensor 48 temporarily decreases to reach a peak taking a value PK. Alternatively the output OP temporarily decreases by DLT. In the timing chart of FIG. 9, the mean output value OPA is kept at the negative value under the control of reducing the stored $SO_X$.

The aforementioned peak value PK, decrease DLT, the time tP elapsing until the peak, and the mean output value OPA are determined in accordance with the reaction state of the reducing agent within the $NO_X$ catalyst 81. The reaction state of the reducing agent is determined in accordance with the flow rate of the exhaust gas flowing through the $NO_X$ catalyst 81 upon supply of the reducing agent. The determination as to whether the flow rate of the exhaust gas upon supply of the reducing agent deviates from the optimum value can be made in accordance with the change in the oxygen concentration of the exhaust gas flowing from the $NO_X$ catalyst 81.

The embodiment is structured to detect the oxygen concentration of the exhaust gas from the $NO_X$ catalyst 81, which is likely to vary with the supply of the reducing agent through the reducing agent supply valve 77. On the basis of the detected oxygen concentration, the control for correcting the flow rate of the exhaust gas is executed.

The actual quantity of the reducing agent through the reducing agent supply valve 77 depends on the time period for supplying the reducing agent. Such supply time period is likely to be influenced by the variation of the individual reducing agent supply valves. This may cause the actual quantity of supplied reducing agent to deviate from the normal quantity.

In the aforementioned case, the determination as to whether the actual quantity of supplied reducing agent deviates from the normal quantity can be made on the basis of the change in the oxygen concentration of the exhaust gas from the $NO_X$ catalyst 81.

The embodiment is structured to detect the oxygen concentration of the exhaust gas discharged from the $NO_X$ catalyst 81, which is likely to vary with the supply of the reducing agent through the reducing agent supply valve 77. On the basis of the detected oxygen concentration, the control of correcting the quantity of the supplied reducing agent is executed such that the quantity of the reducing agent supplied through the reducing agent supply valve 77 becomes the normal quantity.

A first embodiment of the invention will be described hereinafter. In the first embodiment, the control of correcting the quantity of the reducing agent is executed, and upon completion of such control, the control of correcting the flow rate of the exhaust gas is executed.

In the control for correcting quantity of the reducing agent according to the first embodiment, a reducing agent quantity correction coefficient KR is calculated for correcting the supply time period tFN under the control of reducing the stored $NO_X$, and the supply time period tFS under the stored $SO_X$ reducing control such that the quantity of the reducing agent supplied through the reducing agent supply valve 77 becomes the normal quantity. That is, the supply time periods tFN and tFS are corrected using the correction coefficient KR (tFN=tFN·KR, tFS=tFS·KR). If the correction coefficient KR increases, both supply time periods tFN and tFS become long. If the correction coefficient KR decreases, both supply time periods tFS and tFS become short. The correction is not required, the correction coefficient KR is held at 1.0.

The correction coefficient KR is obtained in the following manner. In the first embodiment, in case of a predetermined engine operating state defined by, for example, the engine speed and the required load, the reducing agent is supplied through the reducing agent supply valve 77 for the time period of tF0 while fixing the selector valve 61 in the forward flow position. The predetermined engine operating state may be, for example, an idling operating state. The time period tF0 may be set to the time required for making the outputs OP to become substantially zero, for example.

The oxygen concentration of the exhaust gas discharged from the $NO_X$ catalyst 81 reaches a peak upon supply of the reducing agent. If the quantity of actually supplied reducing agent is larger than the normal quantity corresponding to the time period tF0, the peak value PK of the output OP of the oxygen sensor 48 becomes smaller than the target peak value PKTP (negative value) corresponding to the normal quantity of the reducing agent. If the quantity of actually supplied reducing agent is smaller than the normal quantity, the peak value PK becomes larger than the target peak value PKTP. The target peak value PKTP is the value predetermined by experiments.

The first embodiment is structured to decrease the correction coefficient KR when PK>PKTP, and increase the correction coefficient KR when PK<PKTP. In this way, the correction coefficient KR is updated such that the supply time period tF is changed (tF0=tF0·KR). The correction coefficient KR obtained in the condition where PK=PKTP represents the final correction coefficient.

Under the control of reducing the stored $NO_X$, the reducing agent is supplied for the supply time period tFN corrected with the correction coefficient KR (=tFN·KR). Under the control of reducing the stored $SO_X$, the reducing agent is supplied for the supply time period tFS corrected with the correction coefficient KR (=tFS·KR). Upon completion of calculation of the correction coefficient KR, the control of correcting quantity of the reducing agent ends.

As the control of correcting quantity of the reducing agent is executed in the predetermined engine operating state, the influence of the engine operating state does not have to be considered. As the control is further executed while fixing the selector valve 61 in the forward flow position, the influence of the performance of the selector valve 61 does not have to be considered. If the output OP of the oxygen sensor 48 takes the value around zero, the sensitivity of the oxygen sensor 48 is relatively higher. The reducing agent is then supplied such that the output OP of the oxygen sensor 48 becomes substantially zero. Accordingly the control of correcting quantity of the reducing agent can be executed with higher accuracy.

In the control of correcting flow rate of the exhaust gas according to the first embodiment, an exhaust gas flow rate correction coefficient KEX is calculated for correcting an elapsing time period tC such that the flow rate of the exhaust gas flowing through the $NO_X$ catalyst 81 in the forward direction is held at an optimum value upon supply of the reducing agent under the control of reducing the stored $NO_X$. That is, the elapsing time tC is corrected with the correction coefficient KEX under the control of reducing the stored $NO_X$ (tC=tC·KEX). If the correction coefficient KEX increases, the elapsing time tC becomes long. If the correction coefficient KEX decreases, the elapsing time tC becomes short. If the correction is not required, the KEX is held at 1.0 (KEX=1.0).

The correction coefficient KEX is calculated in the following manner. In the first embodiment, the peak value PK of the output OP from the oxygen sensor 48 is obtained at every execution of the control of reducing the stored $NO_X$. If the actual elapsing time tC from the timing X until supply of the reducing agent is longer than the normal elapsing time, the quantity of the reducing agent that flows through the $NO_X$ catalyst 81 without being oxidized is increased. Accordingly the peak value PK becomes smaller than the target peak value PKT corresponding to the normal elapsing time. If the actual elapsing time tC is shorter than the normal time period, and the direction of the exhaust gas flowing through the $NO_X$ catalyst 81 upon supply of the reducing agent is forward, the reducing agent is gradually oxidized. As a result, the peak value PK becomes smaller than the target peak value PKT. If the actual elapsing time tC is shorter than the normal time period, and the direction of the exhaust gas flowing through the $NO_X$ catalyst 81 upon supply of the reducing agent is reverse, the output OP of the oxygen sensor 48 does not reach the peak.

Likewise if the speed for changing the position of the selector valve 61 is higher than the normal speed, the peak value PK becomes smaller than the target peak value PKT. If the speed for changing the position of the selector valve 61 is lower than the normal speed, and the direction of the exhaust gas that flows through the $NO_X$ catalyst 81 upon supply of the reducing agent is forward, the peak value PK becomes smaller than the target peak value PKT. If the speed for changing the position of the selector valve 61 is lower than the normal speed, and the direction of the exhaust gas that flows through the $NO_X$ catalyst 81 upon supply of the reducing agent is reverse, no peak is reached. The target peak value PKT is a predetermined value obtained through experiments.

In the first embodiment, if the absolute value of the difference between the peak value PK and the target peak value PKT upon increase in the correction coefficient KEX for correcting the flow rate of the exhaust gas, the correction coefficient KEX is further increased. If the absolute value of the difference is increased, the correction coefficient KEX is decreased. If the absolute value of the difference between the peak value PK and the target peak value PKT is decreased upon decrease in the correction coefficient KEX, the KEX is further decreased. If the absolute value of the difference is increased, the correction coefficient KEX is increased. In this way, the correction coefficient KEX is continuously updated, and the elapsing time tC is changed accordingly (tC=tC·KEX). The correction coefficient KEX in the condition where PK=PKT represents the final value.

Under the control of reducing the stored $NO_X$, if the time corrected with the correction coefficient KEX elapses from the timing X (=tC·KEX), the reducing agent is supplied. Accordingly, the control of correcting flow rate of the exhaust gas ends upon completion of calculation of the correction coefficient KEX.

FIGS. 13 to 16 represent each control routine for executing the first embodiment of the invention.

Figure 13:
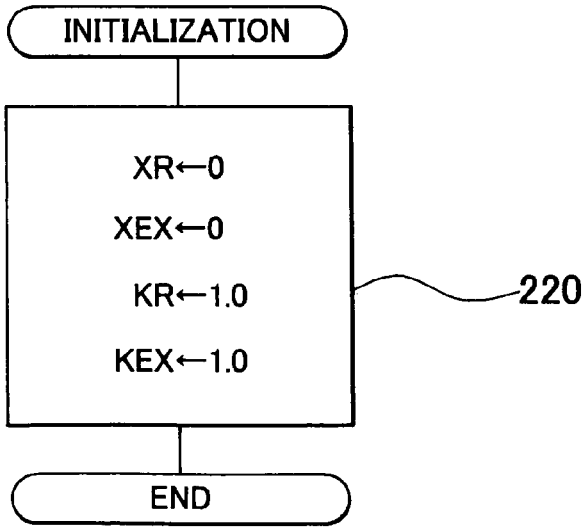
FIG. 13 is a flowchart representing a routine for initialization.

A flowchart shown in FIG. 13 represents the routine of initialization executed once upon first start-up of the internal combustion engine. Referring to the flowchart of FIG. 13, in step 220, a flag XR indicating completion of correcting the reducing agent quantity is reset (XR=0) upon completion of the control of correcting the reducing agent quantity. A flag XEX indicating completion of correcting the flow rate of the exhaust gas, which is set upon completion of the control of correcting the flow rate of the exhaust gas is reset (XEX=0). The correction coefficient KR for correcting the reducing agent quantity is set to 1.0, and the correction coefficient KEX for correcting the flow rate of the exhaust gas is set to 1.0.

Figure 14:
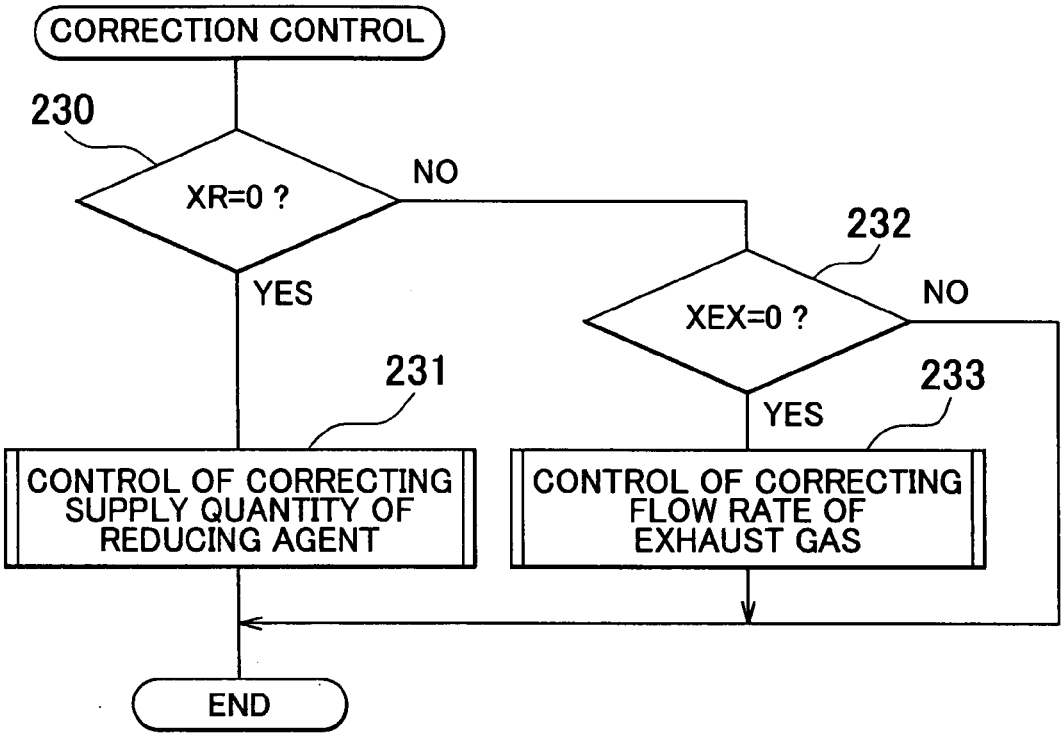
FIG. 14 is a flowchart representing a correction control routine according to a first embodiment.
Figure 15:
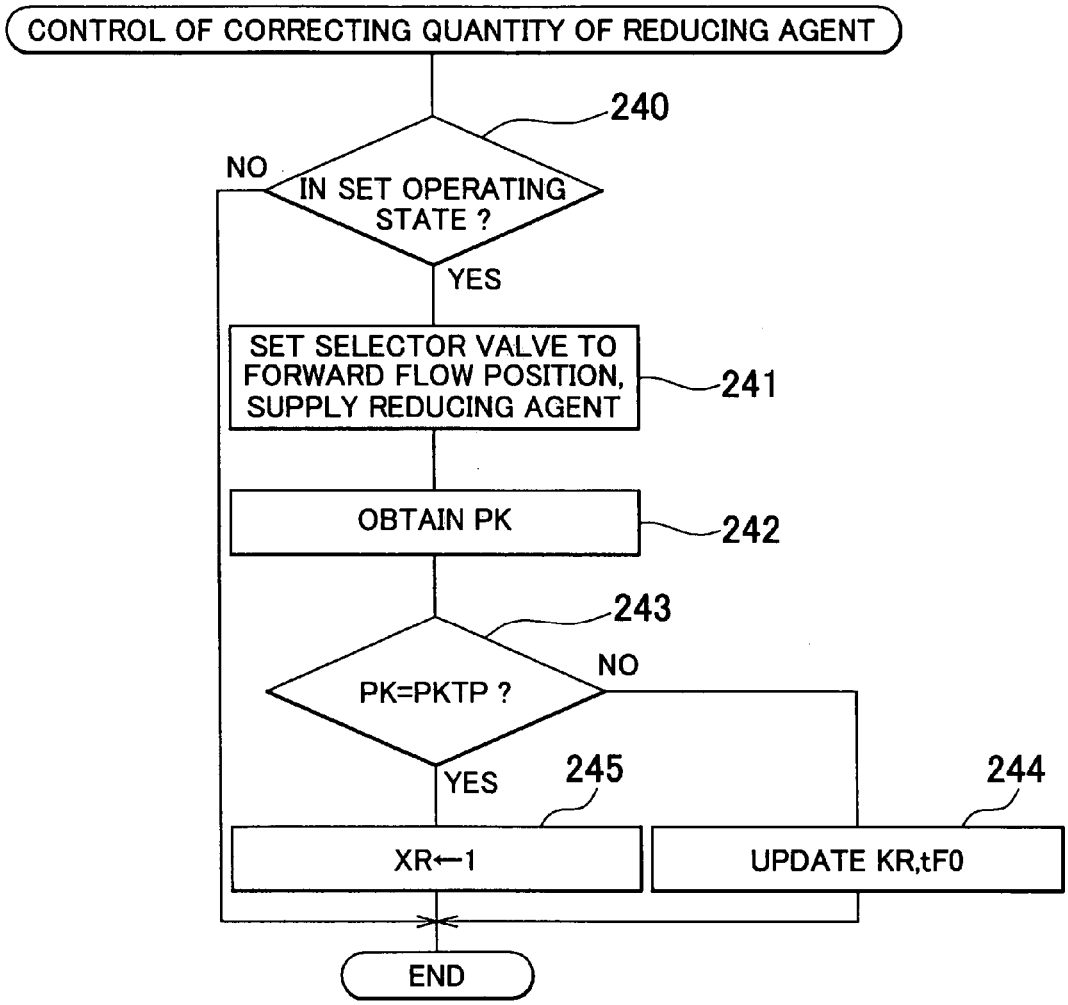
FIG. 15 is a flowchart representing a routine for correcting quantity of the reducing agent according to the first embodiment.

A flowchart of FIG. 14 represents a routine for controlling the correction to be executed upon interruption at every predetermined time interval. Referring to the flowchart of FIG. 14, in step 230, it is determined whether the flag XR has been reset (XR=0). If YES is obtained in step 230, that is, the flag XR has been reset, the process proceeds to step 231 where the routine for controlling correction of the reducing agent quantity as shown in the flowchart of FIG. 15 is executed. If the flag XR is set upon completion of the control of correcting the reducing agent quantity, the process proceeds to step 232 where it is determined whether the flag XEX has been reset (XEX=0). If YES is obtained in step 232, that is, the flag XEX has been reset, the process proceeds to step 233 where a routine for controlling correction of flow rate of the exhaust gas is executed as shown in FIG. 16.

The flowchart of FIG. 15 represents the routine for controlling correction of the reducing agent quantity. Referring to the flowchart, in step 240, it is determined whether the engine operating state accords with the predetermined state. If YES is obtained in step 240, that is, the engine operating state accords with the predetermined state, the process proceeds to step 241. In step 241, the reducing agent is supplied through the reducing agent supply valve 77 for the supply time period of tF0 while holding the selector valve 61 in the forward flow position. Then in step 242, the peak value PK of the output OP of the oxygen sensor 48, which is generated upon supply of the reducing agent is obtained. In step 243, it is determined whether the obtained peak value PK is equal to the target peak value PKTP. If NO is obtained in step 243, that is, PK≠PKTP, the process proceeds to step 244 where the correction coefficient KR and the supply time period tF0 are updated. If YES is obtained in step 243, that is, PK=PKTP, the process proceeds to step 245 where the flag XR is set (XR=1).

Figure 16:
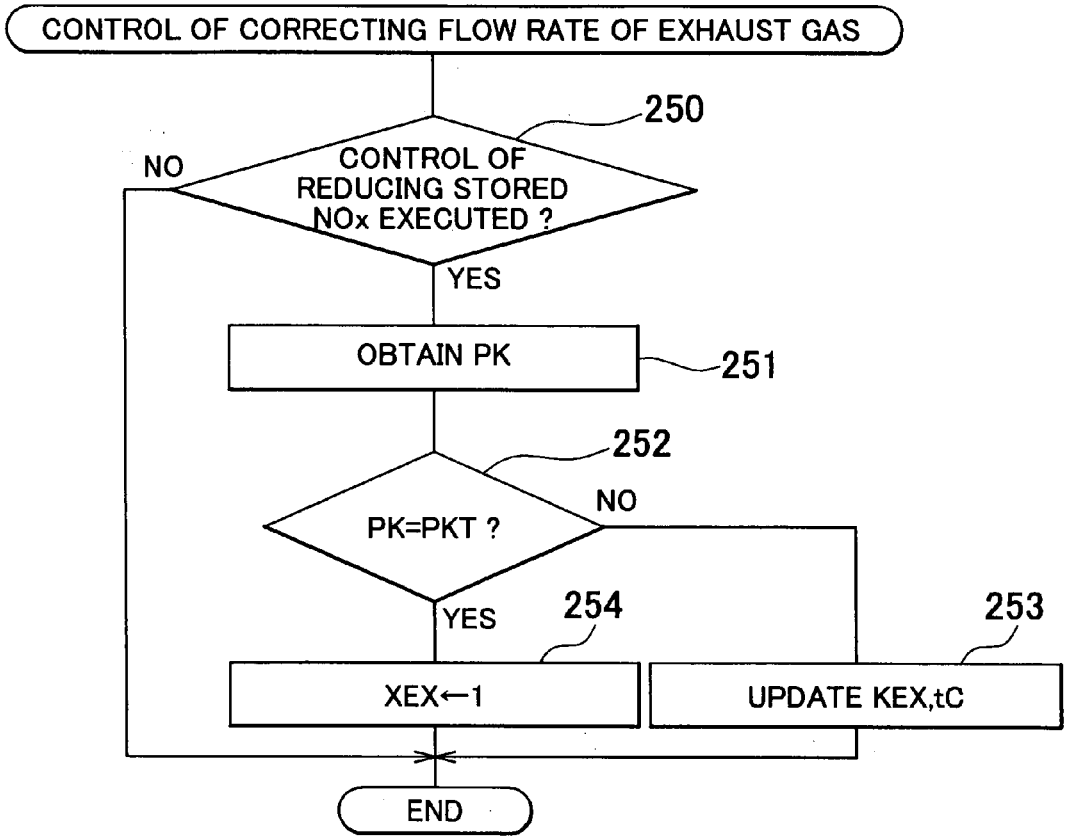
FIG. 16 is a flowchart representing a control routine for correcting the exhaust gas quantity according to the first embodiment.

A flowchart shown in FIG. 16 represents a routine for controlling correction of flow rate of the exhaust gas. Referring to the flowchart, in step 250, it is determined whether the control routine for reducing the stored $NO_X$ that has been described referring to FIG. 6 is executed, that is, the reducing agent has been supplied through the reducing agent supply valve 77. If YES is obtained in step 250, that is, the reducing agent has been supplied, the process proceeds to step 251 where the peak value PK of the output, OP of the oxygen sensor 48, which is generated upon supply of the reducing agent is obtained. Then in step 252, it is determined whether the peak value PK is equal to the target peak value PKT. If NO is obtained in step 252, that is, PK≠PKT, the process proceeds to step 253 where the correction coefficient KEX and the elapsing time tC are updated. If YES is obtained in step 252, that is, PK=PKT, the process proceeds to step 254 where the flag XEX is set (XEX=1).

A second embodiment of the invention will be described hereinafter. The second embodiment is structured to execute the control of correcting flow rate of the exhaust gas after execution of the control of correcting quantity of the reducing agent as in the first embodiment. The control of correcting quantity of the reducing agent in the second embodiment is executed in the same manner as in the first embodiment. However, the control of correcting flow rate of the exhaust gas in the second embodiment is different from that of the first embodiment as described below.

In the control of correcting flow rate of the exhaust gas according to the second embodiment, the coefficient KEX for correcting flow rate of the exhaust gas is calculated so as to correct the speed V for selecting the position of the selector valve 61 under the control of reducing the stored $NO_X$. That is, the speed V is corrected with the coefficient KEX (V=V·KEX). If the coefficient KEX increases, the speed V becomes higher. If the coefficient KEX decreases, the speed V becomes lower. As the selector valve 61 is driven by the stepping motor 60, the speed V for selecting the position of the selector valve 61 is variable.

More specifically, the time tP elapsing from the timing X until timing when the output OP of the oxygen sensor 48 reaches a peak is obtained at every execution of the control of reducing the stored $NO_X$ (see FIG. 7). If the actual time period tC elapsing from the timing X until the timing at which the reducing agent is supplied is longer than the normal time period, the space velocity of the exhaust gas upon supply of the reducing agent becomes higher. Accordingly the actual time tP elapsing until the peak is reached becomes shorter than the target elapsing time period tPT corresponding to the normal elapsing time period. If the actual time period tC elapsing until supply of the reducing agent is shorter than the normal time period, and the direction of the exhaust gas flowing through the $NO_X$ catalyst 81 upon supply of the reducing agent is forward, the actual elapsing time tP becomes longer than the target elapsing time period tPT. If the actual time period tC is shorter than the normal elapsing time, and the direction of the exhaust gas flowing through the $NO_X$ catalyst 81 upon supply of the reducing agent is reverse, there is no peak in the output OP of the oxygen sensor 48.

If the speed for selecting the position of the selector valve 61 is higher than the normal speed, the elapsing time tP becomes shorter than the target elapsing time tPT. If the speed for selecting the position of the selector valve 61 is lower than the normal speed, and the direction of the exhaust gas flowing through the $NO_X$ catalyst 81 upon supply of the reducing agent is forward, the elapsing time tP becomes longer than the target elapsing time tPT. If the speed for selecting the position of the selector valve 61 is lower than the normal speed, and the direction of the exhaust gas flowing through the $NO_X$ catalyst 81 upon supply of the reducing agent is reverse, there is no peak in the output of the oxygen sensor. The target elapsing time tPT is predetermined through experiments.

In the second embodiment, the coefficient KEX is increased at relatively a lower rate in the condition where tP>tPT. In the case where no peak is formed even if a predetermined time period has elapsed from the timing X, the coefficient KEX is increased at relatively a higher rate. The coefficient KEX is decreased in case of the condition where tP<tPT. In this way, the correction coefficient KEX is continuously updated, and the speed V for selecting the position of the selector valve 61 is changed accordingly (V=V·KEX). In the condition where tP=tPT, the correction coefficient becomes a final correction coefficient.

Under the control of reducing the stored $NO_X$, the position of the selector valve 61 is selected from the forward flow position to the reverse flow position or vice versa at the speed V that has been corrected with the correction coefficient KEX.

Figure 17:
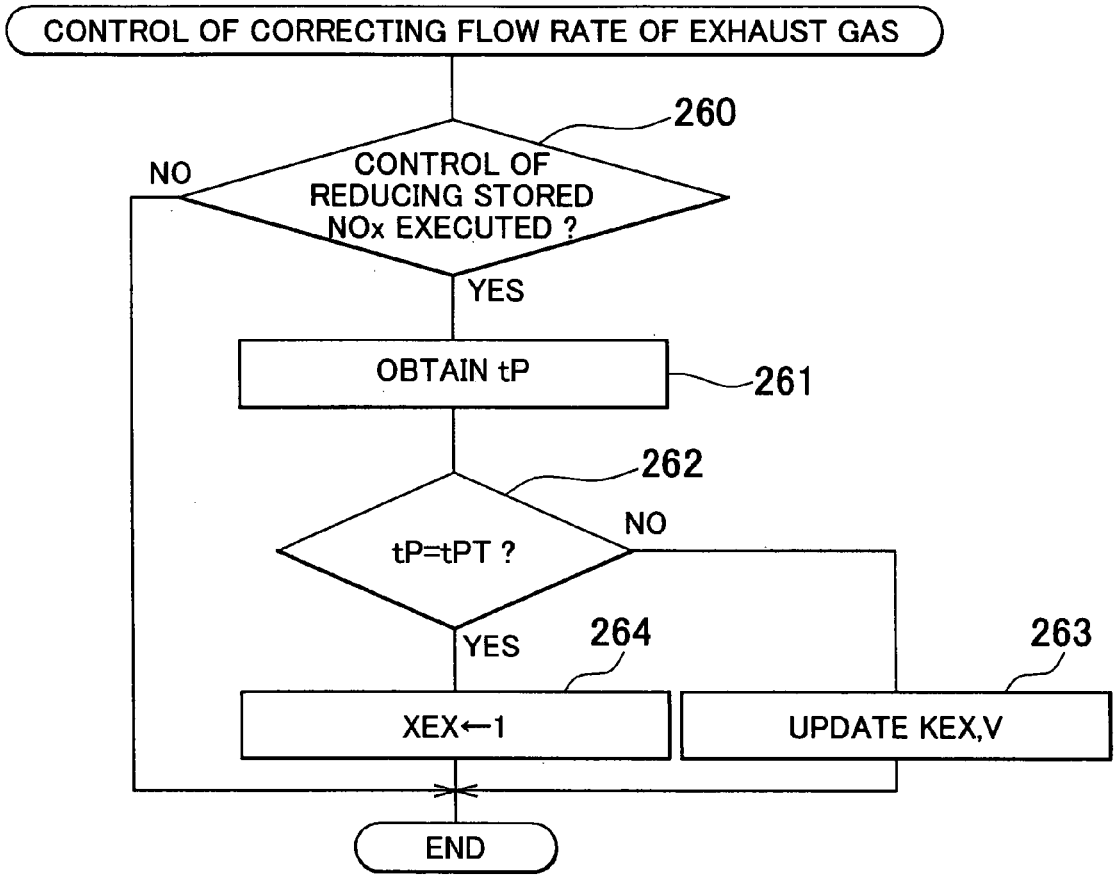
FIG. 17 is a flowchart representing a control routine for correcting the exhaust gas quantity according to a second embodiment.

A flowchart of FIG. 17 represents a control routine for correcting flow rate of the exhaust gas according to the second embodiment. The routine shown in FIGS. 13 to 15 is executed in the second embodiment. The control routine for correcting flow rate of the exhaust gas shown in FIG. 17 corresponds to step 233 of the correction control routine shown in FIG. 14.

Figure 6:
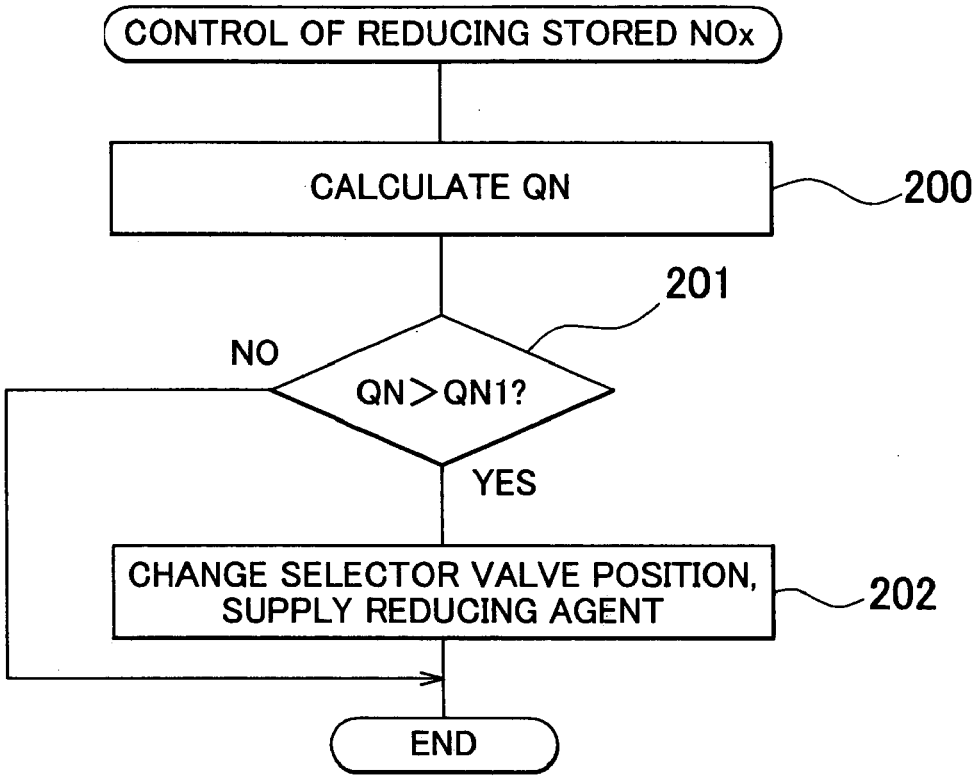
FIG. 6 is a flowchart representing a control routine for decreasing stored $NO_X$.

Referring to the flowchart of FIG. 17, in step 260, it is determined whether the control routine for reducing the stored $NO_X$ as described referring to FIG. 6 has been executed, that is, the reducing agent has been supplied through the reducing agent supply valve 77. If YES is obtained in step 260, that is, the reducing agent has been supplied, the process proceeds to step 261 where the time tP elapsing from the timing when the signal instructing to select the position of the selector valve 61 until the output OP of the oxygen sensor 48 reaches the peak is obtained. Then in step 262, it is determined whether the elapsing time tP is equal to the target elapsing time tPT. If NO is obtained in step 262, that is, tP≠tPT, the process proceeds to step 263. In step 263, the correction coefficient KEX and the speed V for selecting the position of the selector valve 61 are updated as described above. If YES is obtained in step 262, that is, tP=tPT, the process proceeds to step 264 where the flag XEX is set (XEX=1).

A third embodiment of the invention will be described hereinafter. The third embodiment is structured to execute the control of correcting flow rate of the exhaust gas after the control of correcting quantity of the reducing agent as in the aforementioned embodiments. The control of correcting quantity of the reducing agent is executed in the same manner as in the first embodiment. The control of correcting flow rate of the exhaust gas in the third embodiment, however, is different from the aforementioned control as described below.

According to the third embodiment, the coefficient KEX is calculated for correcting the opening degree D corresponding to the weak forward flow position of the selector valve 61 such that the flow rate of the exhaust gas flowing through the $NO_X$ catalyst in the forward direction upon supply of the reducing agent is held at the optimum value. In the third embodiment, the opening degree D is corrected with the coefficient KEX (D=D·KEX). In this case, if the coefficient KEX increases, the opening degree D becomes large. Meanwhile, if the correction coefficient KEX decreases, the opening degree D becomes small.

Under the control of reducing the stored $SO_X$, the mean value OPA of outputs of the oxygen sensor 48 is obtained as shown in FIG. 9. If the actual opening degree D is larger than the normal opening degree, the flow rate of the exhaust gas flowing through the $NO_X$ catalyst 81 becomes large. Accordingly, the mean value OPA becomes larger than the target output value OPAT corresponding to the normal opening degree. If the actual opening degree is smaller than the normal opening degree, the flow rate of the exhaust gas flowing through the $NO_X$ catalyst 81 is decreased. Therefore, the mean output value OPA becomes smaller than the target output value OPAT. The target output value OPAT is experimentally predetermined.

In the third embodiment, in the condition where OPA>OPAT, the coefficient KEX is decreased, and in the condition where OPA<OPAT, the correction coefficient KEX is increased. In this way, the correction coefficient KEX is continuously updated such that the time for supplying the reducing agent tF0 is also updated (D=D·KEX). The condition where OPA=OPAT represents that the correction coefficient KEX used herein is the final correction coefficient.

Under the control of reducing the stored $SO_X$, the reducing agent is supplied while holding the opening degree D of the selector valve 61.

Figure 18:
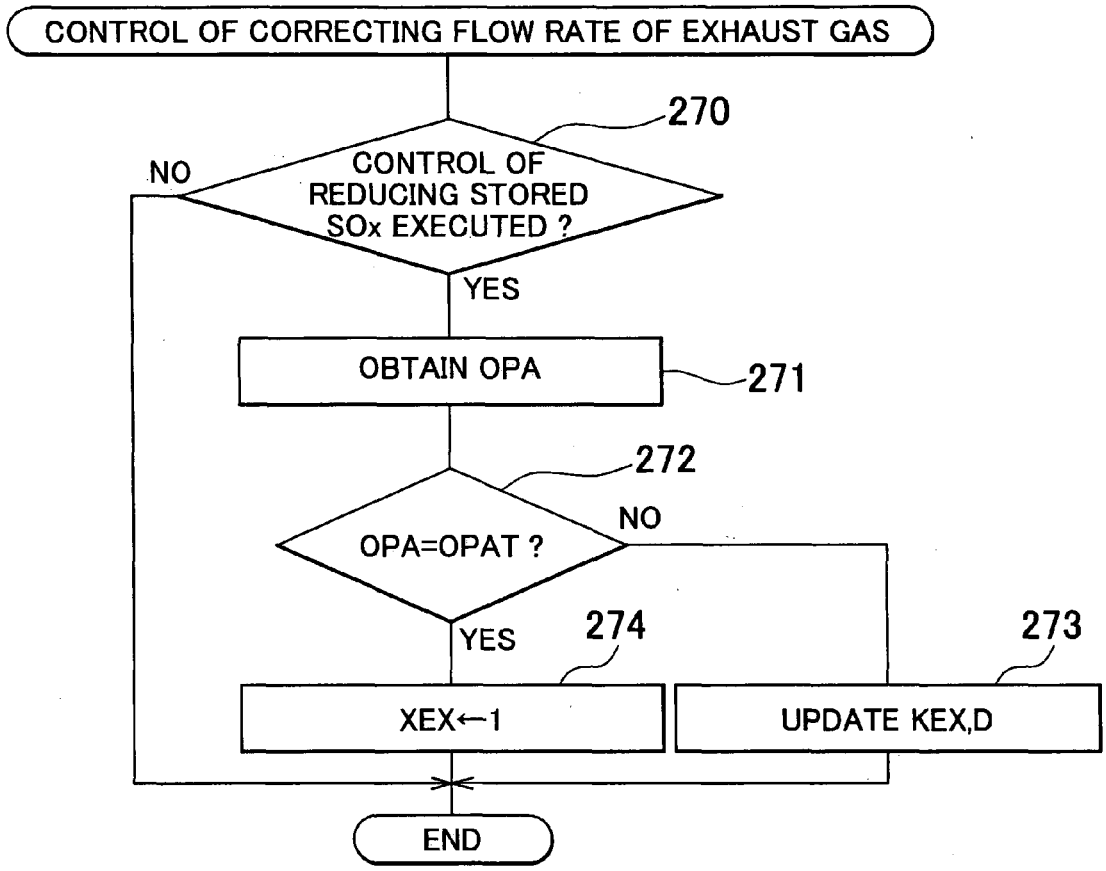
FIG. 18 is a flowchart representing a control routine for correcting the exhaust gas quantity according to a third embodiment.

A flowchart in FIG. 18 represents the control routine for correcting the flow rate of the exhaust gas according to the third embodiment. The routine of the third embodiment is executed as shown in FIGS. 13 to 15. The control routine for correcting the flow rate of the exhaust gas shown in FIG. 18 is executed in step 233 of the correction control routine shown in FIG. 14.

Referring to FIG. 18, in step 270, it is determined whether the control routine for reducing the stored $NO_X$ has been executed, that is, the reducing agent has been supplied through the reducing agent supply valve 77 as described referring to FIG. 6. If YES is obtained in step 270, that is, the reducing agent has been supplied, the process proceeds to step 271 where the mean value OPA of the outputs OP of the oxygen sensor 48 is obtained. Then in step 272, it is determined whether the OPA is equal to a target value OPAT. In NO is obtained in step 272, that is, OPA≠OPAT, the process proceeds to step 273 where the flag KEX and the opening degree D are updated. If YES is obtained in step 272, that is, OPA=OPTAT, the flag XEX is set (XEX=1).

In the third embodiment, the control of correcting flow rate of the exhaust gas is executed on the basis of the oxygen concentration of the exhaust gas discharged from the $NO_X$ catalyst 81 upon execution of the control of reducing the stored $SO_X$. In the first or the second embodiment, the control of correcting the flow rate of the exhaust gas is executed on the basis of the oxygen concentration of the exhaust gas discharged from the $NO_X$ catalyst 81 upon execution of the control of reducing the stored $NO_X$.

A fourth embodiment of the invention will be described. In this embodiment, the control of correcting flow rate of the exhaust gas is executed. Upon completion of the control routine, the control of correcting the quantity of the reducing agent is then executed.

Under the control of correcting flow rate of the exhaust gas according to the first embodiment, the elapsing time tC is corrected such that the peak value PK (negative value) of the output OP of the oxygen sensor 48 becomes minimum. Alternatively, the coefficient KEX that makes the peak value minimum is obtained. The peak value PK as the minimum value accords with the target peak value PKT.

Under the control of correcting the flow rate of the exhaust gas according to the fourth embodiment, the elapsing time tC is corrected such that the peak value PK becomes minimum, or the coefficient KEX that makes the peak value PK minimum is obtained. More specifically, if the peak value PK decreases upon increase in the correction coefficient KEX, the KEX is decreased. Meanwhile, if the peak value PK increases, the KEX is further increased. If the peak value PK decreases upon decrease in the correction coefficient KEX, the KEX is increased. Meanwhile, if the peak value PK increases, the KEX is further decreased.

The minimum peak value is obtained under the control of correcting flow rate of the exhaust gas before execution of the control of correcting quantity of the reducing agent. Accordingly the minimum peak value does not always accord with the target peak value PKT.

Under the control of correcting the quantity of the reducing agent according to the fourth embodiment, the time period tF for supplying the reducing agent is corrected such that the minimum peak value obtained under the control of correcting flow rate of the exhaust gas accords with the target peak value PKT. Alternatively, the coefficient KR for correcting quantity of the reducing agent is obtained such that the minimum peak value accords with the target peak value PKT. More specifically, in the condition where PK>PKT, the correction coefficient KR is decreased, and PK<PKT, the correction coefficient KR is increased.

Figure 19:
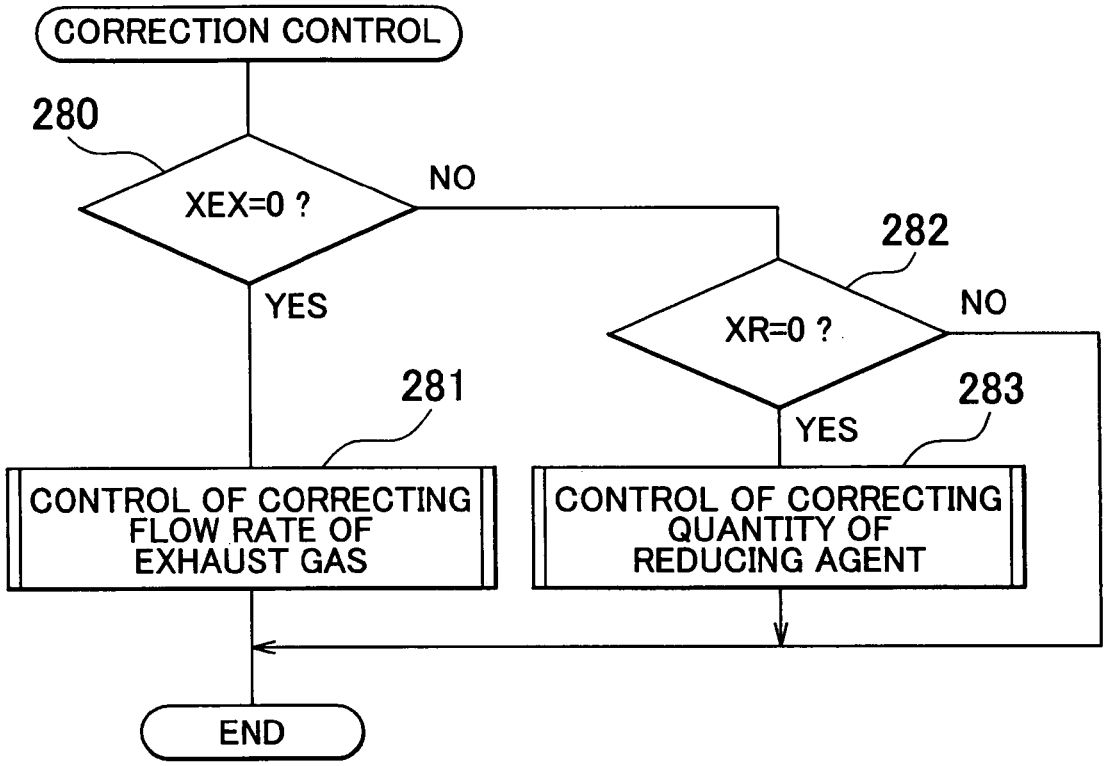
FIG. 19 is a flowchart representing a correction control routine according to a fourth embodiment.
Figure 20:
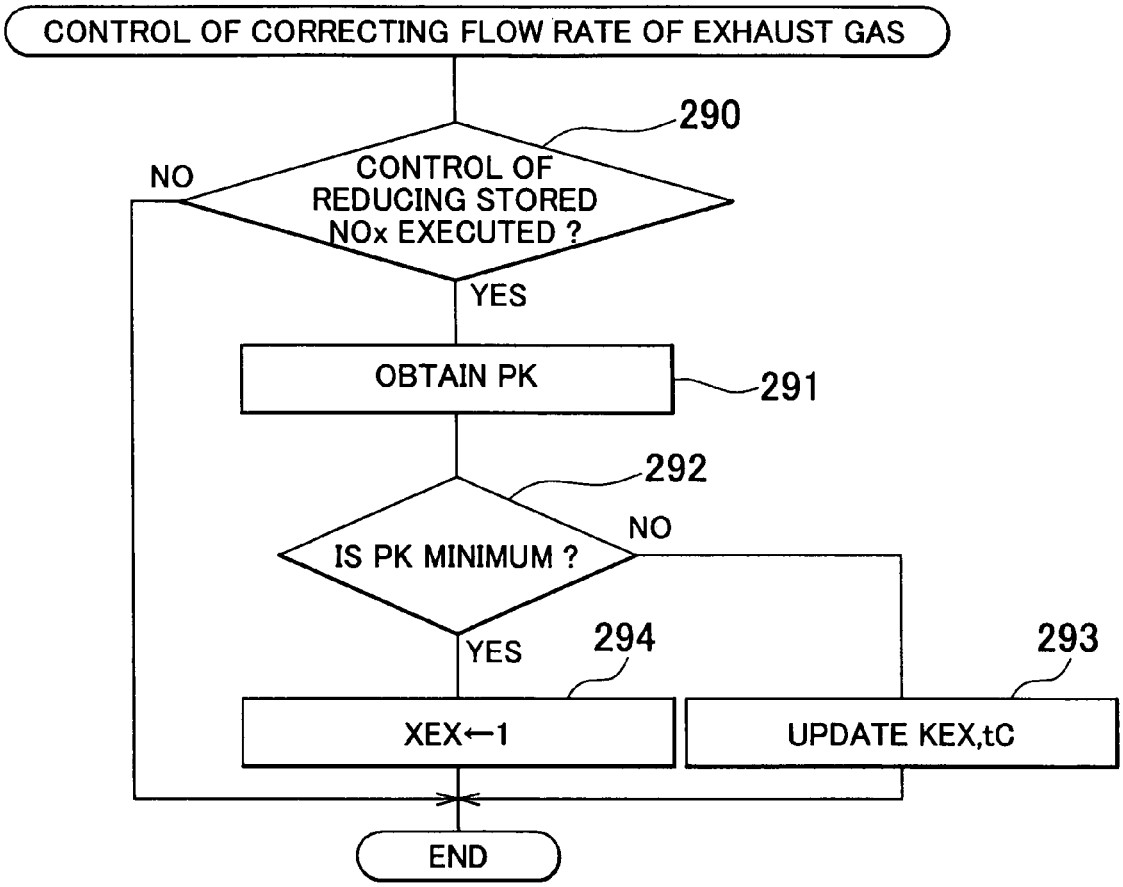
FIG. 20 is a flowchart representing a control routine for correcting the exhaust gas quantity according to the fourth embodiment.
Figure 21:
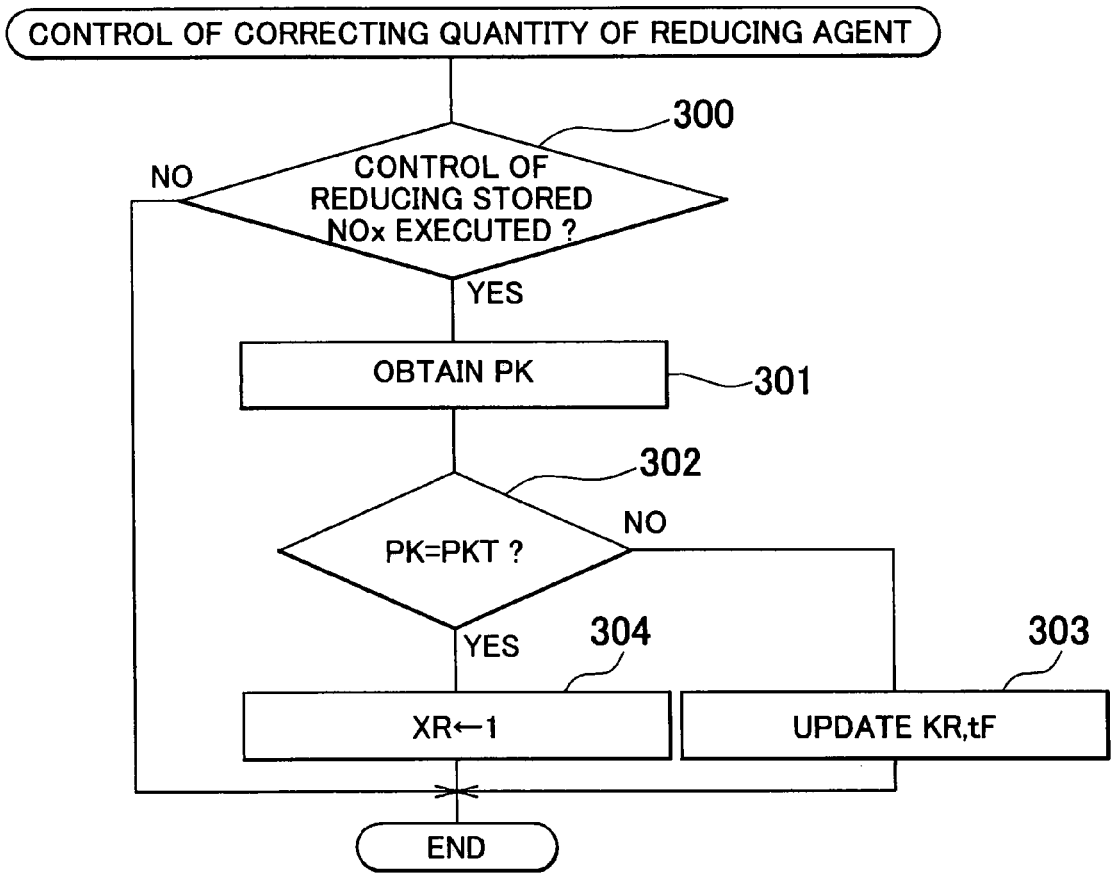
FIG. 21 is a flowchart representing a control routine for correcting the reducing agent quantity according to the fourth embodiment.

The control routine according to the fourth embodiment is shown in FIGS. 19 to 21. The routine for initialization as shown in FIG. 13 is also executed.

The correction control routine shown in FIG. 19 is executed upon every interruption at a predetermined time interval. Referring to FIG. 19, in step 280, it is determined whether the flag XEX indicating completion of the correction of the flow rate of the exhaust gas is reset (XEX=0). If YES is obtained in step 280, that is, the flag XEX has been reset, the process proceeds to step 281 where the control routine of correcting flow rate of the exhaust gas shown in FIG. 20 is executed. When the flag XEX is set upon completion of the control of correcting flow rate of the exhaust gas, the process proceeds to step 282 from step 280. In step 282, it is determined whether the flag XR indicating completion of correcting quantity of the reducing agent has been reset (XR=0). If YES is obtained in step 282, that is, the flag XR has been reset, the process proceeds to step 283 where the control routine of correcting quantity of the reducing agent is executed as shown in FIG. 21.

The control routine of correcting flow rate of the exhaust gas according to the fourth embodiment will be described referring to FIG. 20. In step 290 of the flowchart in FIG. 20, it is determined whether the control routine for reducing the stored $NO_X$ as described referring to FIG. 6 has been executed, that is, the reducing agent has been supplied through the reducing agent supply valve 77. If YES is obtained in step 290, that is, the reducing agent has been supplied, the process proceeds to step 291 where the peak value PK of the output OP of the oxygen sensor 48 which is generated upon supply of the reducing agent is obtained. Then in step 292, it is determined whether the peak value PK is a minimum peak value. If NO is obtained in step 292, that is, the peak value PK is not the minimum peak value, the process proceeds to step 293 where the correction coefficient KEX and the elapsing time tC are updated as described above. If YES is obtained in step 292, that is, the peak value PK becomes the minimum peak value, the process proceeds to step 294 where the correction flag XEX is set (XEX=1).

The flowchart shown in FIG. 21 represents the control routine for correcting quantity of the reducing agent according to the fourth embodiment. In step 300 of the flowchart in FIG. 21, it is determined whether the control routine of reducing the stored $NO_X$ as described referring to FIG. 6 has been executed, that is, the reducing agent has been supplied through the reducing agent supply valve 77. If YES is obtained in step 300, that is, the reducing agent has been supplied, the process proceeds to step 301. In step 301, the peak value PK of the output OP of the oxygen sensor 48 which is generated upon supply of the reducing agent is obtained. Then in step 302, it is determined whether the peak value PK is equal to the target peak value PKT. If NO is obtained in step 302, that is, PK≠PKT, the process proceeds to step 303 where the correction coefficient KR and the elapsing time tF are updated as described above. If YES is obtained in step 302, that is, PK=PKT, the process proceeds to step 304 where the correction flag XR is set (XR=1).

In the aforementioned embodiments, the exhaust sensor 48 constitutes the oxygen sensor for detecting the oxygen concentration of the exhaust gas discharged from the $NO_X$ catalyst 81 upon supply of the reducing agent. The control of correcting quantity of the reducing agent or correcting flow rate of the exhaust gas may be executed on the basis of the detected oxygen concentration. The aforementioned control may be executed on the basis of other parameters representing the state of the exhaust gas discharged from the $NO_X$ catalyst 81 upon supply of the reducing agent.

Figure 22:
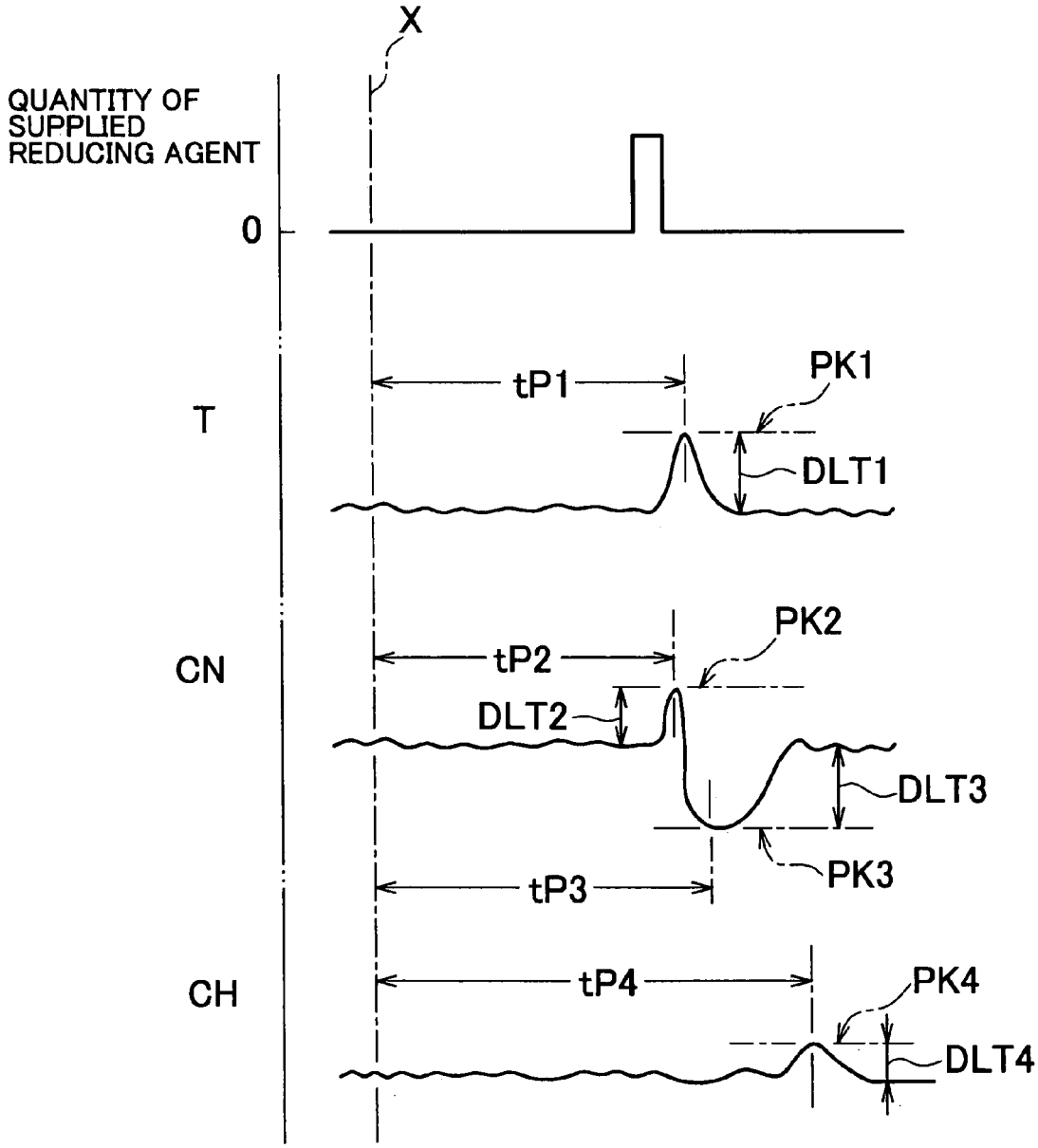
FIG. 22 is a graph representing the quantity of the exhaust gas detected upon supply of the reducing agent.

The timing chart shown in FIG. 22 represents the change in parameters each indicating the state of the exhaust gas discharged from the $NO_X$ catalyst 81 upon supply of the reducing agent through the reducing agent supply valve 77 while changing the selector valve 61 between the forward and the reverse flow positions.

Referring to the timing chart in FIG. 22, upon elapse of time tP1 from the timing X at which the signal instructing to change the position of the selector valve 61 is generated, the temperature T of the exhaust gas temporarily increases to reach a peak of PK1. That is, the temperature T increases by DLT1. If the quantity of the reducing agent actually supplied to the $NO_X$ catalyst 81 is larger than the normal quantity, the temperature increase DLT1 becomes large. On the contrary, if the quantity of the reducing agent actually supplied to the $NO_X$ catalyst 81 is smaller than the normal quantity, the temperature increase DLT1 becomes small. If the flow rate of the exhaust gas flowing through the $NO_X$ catalyst 81 upon supply of the reducing agent is higher than the optimum flow rate, the quantity of the reducing agent that passes through the $NO_X$ catalyst 81 without being oxidized becomes large. Accordingly, the temperature increase DLT1 becomes small. On the contrary, if the flow rate of the exhaust gas that passes through the $NO_X$ catalyst 81 upon supply of the reducing agent is lower than the optimum flow rate, the reducing agent is gradually oxidized. Accordingly, the temperature increase DLT1 becomes small.

Upon elapse of time tP2 from the timing X, the $NO_X$ concentration CN of the exhaust gas temporarily increases to reach a peak of PK2. That is, the $NO_X$ concentration CN increases by DLT2. If the quantity of the reducing agent actually supplied to the $NO_X$ catalyst 81 is larger than the normal quantity, the increase DLT2 in the $NO_X$ concentration CN becomes small. If the quantity of the reducing agent is smaller than the normal quantity, the increase DLT2 in the $NO_X$ concentration CN becomes large. If the flow rate of the exhaust gas that flows through the $NO_X$ catalyst 81 upon supply of the reducing agent is higher than the optimum flow rate, the increase DLT2 becomes large. If the flow rate of the exhaust gas is lower than the optimum flow rate, the increase DLT2 also becomes small.

Upon elapse of the time tP3 from the timing X, the $NO_X$ concentration CN temporarily decreases to reach a peak of PK3. That is, the $NO_X$ concentration CN decreases by DLT3. If the quantity of the reducing agent actually supplied to the $NO_X$ catalyst 81 is larger than the normal quantity, the decrease DLT3 becomes large, for example. If the quantity of the reducing agent is smaller than the normal quantity, the decrease DLT3 becomes small. If the flow rate of the exhaust gas that flows through the $NO_X$ catalyst 81 upon supply of the reducing agent is higher than the optimum flow rate, the decrease DLT3 becomes small. If the flow rate of the exhaust gas is lower than the optimum flow rate, the decrease DLT3 also becomes small.

Upon elapse of the time tP4 from the timing X, the concentration CH of the reducing agent temporarily increases to reach a peak of PK4. That is, the concentration CH of the reducing agent increases by DLT4. If the quantity of the reducing agent actually supplied to the $NO_X$ catalyst 81 is larger than the normal quantity, the increase DLT4 becomes large. On the contrary, if the quantity of the reducing agent is smaller than the normal quantity, the increase DLT4 becomes small. If the flow rate of the exhaust gas that flows through the $NO_X$ catalyst 81 upon supply of the reducing agent is higher than the optimum flow rate, the increase DLT4 becomes large. On the contrary, if the flow rate of the exhaust gas is lower than the optimum flow rate, the increase DLT4 becomes small. The state of the exhaust gas may be changed in the same manner as aforementioned if the reducing agent is supplied while holding the selector valve 62 in the forward or the weak forward flow position.

In this embodiment, the control of correcting quantity of the reducing agent may be executed such that the increase DLT1 in the temperature T of the exhaust gas upon supply of the reducing agent while holding the selector valve 61 in the forward flow position reaches the target value. Then the control of correcting flow rate of the exhaust gas may be executed such that the increase DLT1 in the temperature T of the exhaust gas upon supply of the reducing agent while changing the position of the selector valve 61 between the forward and the reverse flow positions reaches the target value.

Assuming that a temperature sensor, a $NO_X$ sensor, or a reducing agent (hydrocarbon) concentration sensor is used as the exhaust sensor 48, the control of correcting quantity of the reducing agent or correcting flow rate of the exhaust gas may be executed on the basis of the temperature T, the $NO_X$ concentration CN, or the reducing agent concentration CH of the exhaust gas discharged from the $NO_X$ catalyst upon supply of the reducing agent.

Alternatively, different types of sensors each detecting different state of the exhaust gas may be employed so as to execute the control of correcting the quantity of the reducing agent or correcting the flow rate of the exhaust gas on the basis of parameters detected by those sensors. The control of correcting quantity of the reducing agent may be executed on the basis of the exhaust gas temperature, and the control of correcting flow rate of the exhaust gas may be executed on the basis of the oxygen concentration of the exhaust gas.

Another embodiment of the control of reducing the stored $SO_X$ will be described hereinafter.

The actual opening degree D of the selector valve 61 larger than the normal opening degree represents that the flow rate of the exhaust gas flowing through the $NO_X$ catalyst 81 is higher larger than the optimum flow rate. Accordingly the quantity of the reducing agent that effectively functions within the $NO_X$ catalyst 81 is decreased. Meanwhile, the actual opening degree D smaller than the normal opening degree represents that the quantity of the reducing agent that effectively functions within the $NO_X$ catalyst 81 is increased. If the quantity of the effectively functioning reducing agent is decreased, the time required to make the quantity of $SO_X$ stored within the $NO_X$ catalyst 81 substantially zero may become longer. On the contrary, if the quantity of the effectively functioning reducing agent is increased, such time may become shorter.

If the quantity of the effectively functioning reducing agent is decreased as described above, the mean value OPA of outputs of the oxygen sensor 48 under the control of reducing the stored $SO_X$ becomes large. Meanwhile, if the quantity of the effectively functioning reducing agent is increased, the mean value OPA becomes small.

Figure 23:
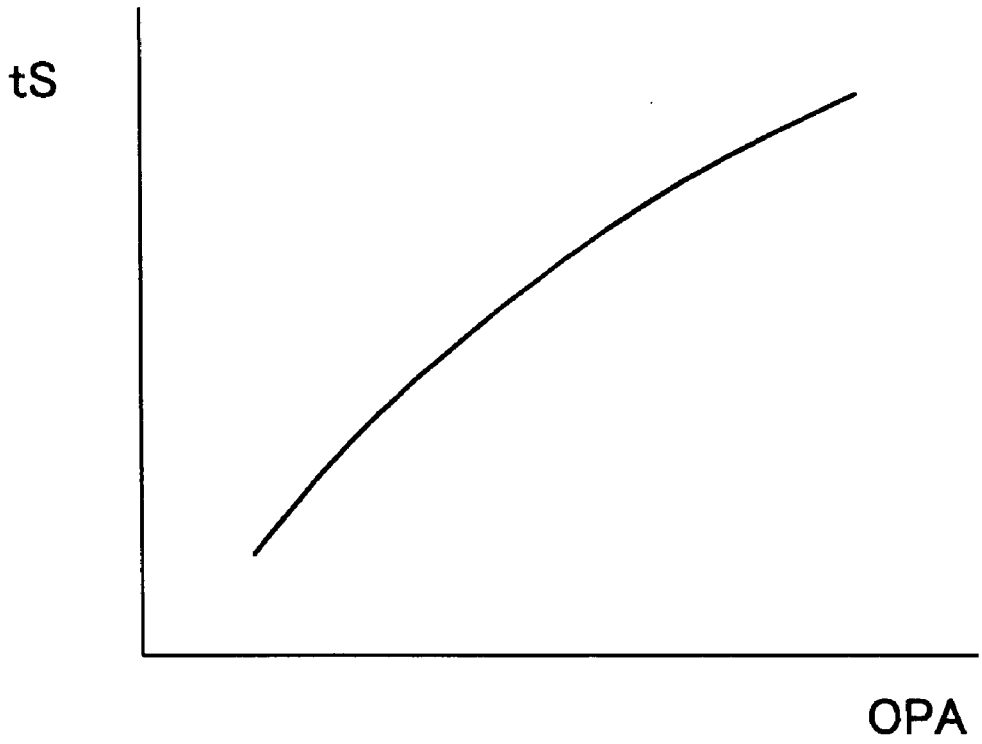
FIG. 23 is a graph representing the time for which the control for reducing the quantity of the stored $SO_X$ is continued.

In this embodiment, under the control of reducing the stored $SO_X$, the time tS for which such control is continued is corrected so as to be longer as the mean value OPA becomes larger. In other words, if the actual opening degree D is larger than the normal opening degree, the time tS is corrected to be longer. If the actual opening degree D is smaller than the normal opening degree, the time tS is corrected to be shorter. The time tS is preliminarily stored in the ROM 43 in the form of a map as shown in FIG. 23.

Figure 24:
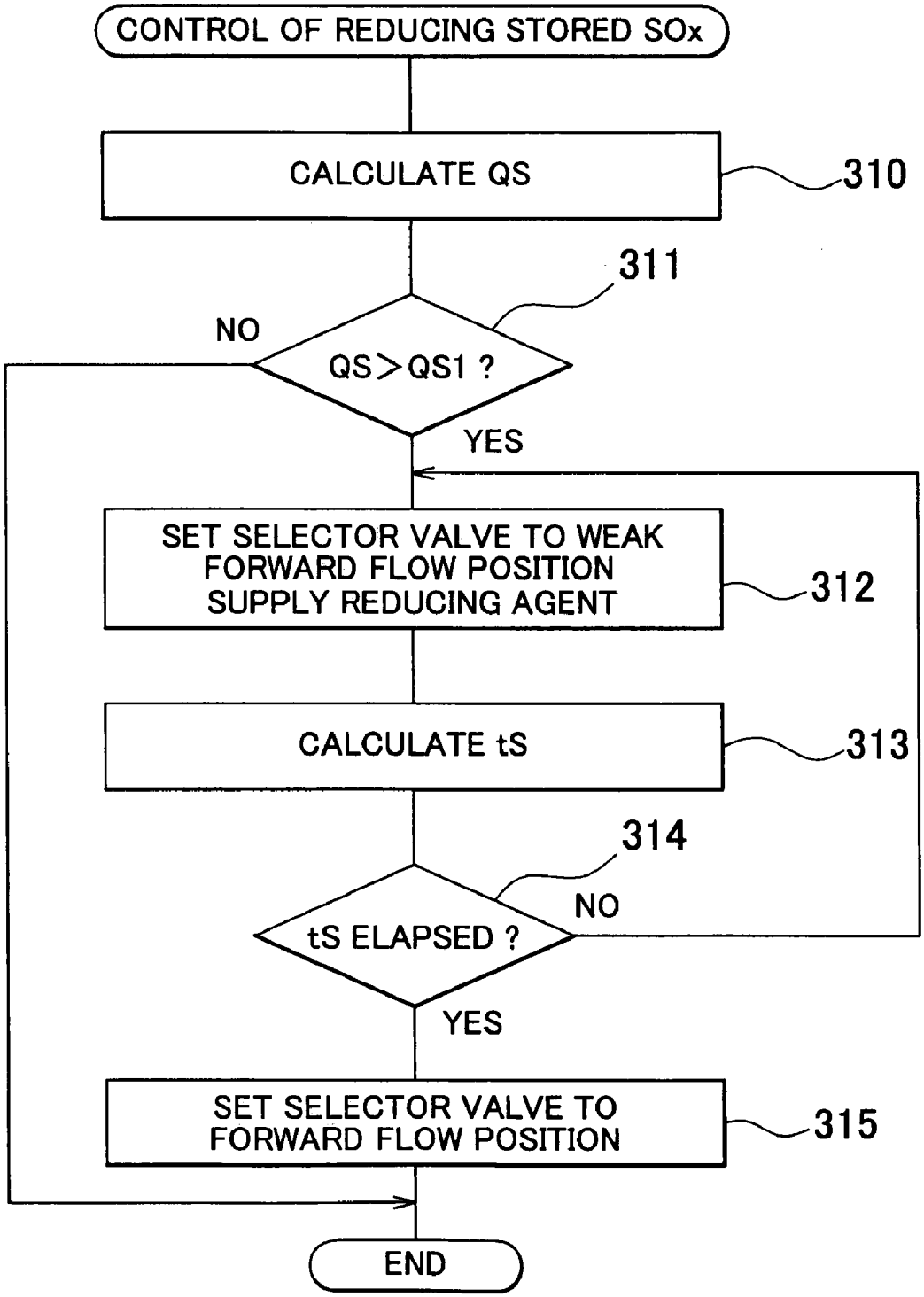
FIG. 24 is a flowchart representing a control routine for decreasing the stored $SO_X$ according to another embodiment.

The flowchart of FIG. 24 represents the routine for executing the control of reducing the stored $SO_X$ according to the embodiment. In step 310 of the flowchart, the quantity of $SO_X$ stored in the $NO_X$ catalyst 81, that is, QS is calculated. Then in step 311, it is determined whether the QS is larger than the allowable quantity QS1. If NO is obtained in step 310, that is, QS≦QS1, the control routine ends. If YES is obtained in step 310, that is, QS>QS1, the process proceeds to step 312. In step 312, the reducing agent is intermittently supplied through the reducing agent supply valve 77 while setting the selector valve 61 to be in the weak forward flow position from the forward flow position and holding the selector valve 61 in the selected position. Then in step 313, the time tS is calculated using the map shown in FIG. 23. In step 314, it is determined whether the time tS has been elapsed from supply of the reducing agent while holding the selector valve 61 in the weak forward flow position. If NO is obtained in step 314, the process returns to step 312 until the time tS elapses. The reducing agent is repeatedly supplied while holding the selector valve 61 in the weak forward flow position until elapse of the time tS. If YES is obtained in step 314, that is, the time tS has elapsed, the process proceeds to step 315 where the selector valve 61 is selected to the forward flow position, for example. The control of reducing the stored $SO_X$ is, then, completed.

The internal combustion engine as shown in FIG. 1 has the exhaust sensor 48 provided in the annular exhaust pipe 67 so as to avoid the influence caused by the exhaust gas that bypasses the $NO_X$ catalyst 81 to directly flow from the inlet port 62 to the outlet port 63 of the selector valve 61. The exhaust sensor 48, however, may be provided within the exhaust discharge pipe 64 between the outlet port 63 of the selector valve 61 and the auxiliary catalyst 76.

Figure 25:
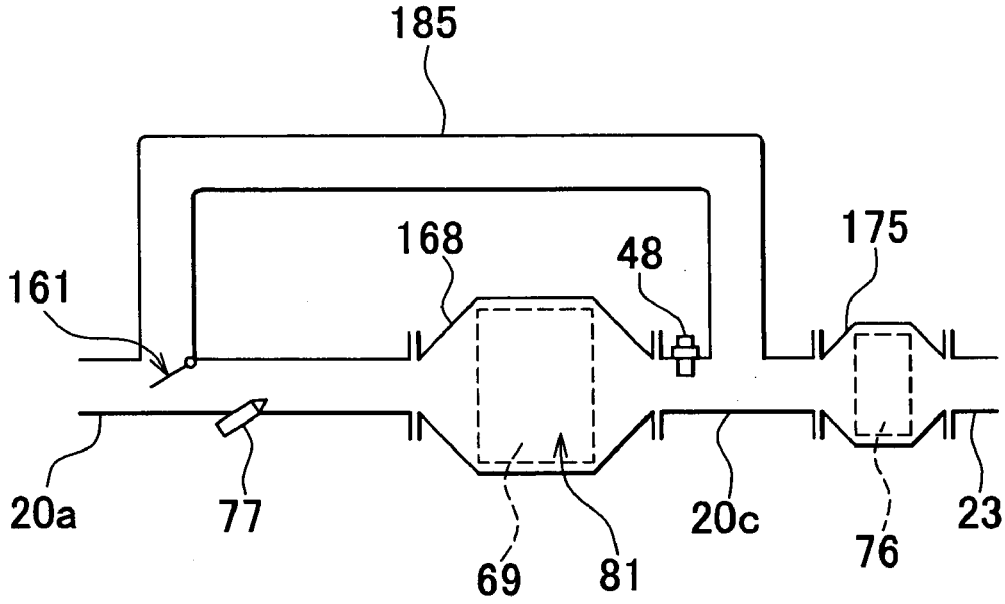
FIG. 25 is a view representing another type of the internal combustion engine.
Figure 27:
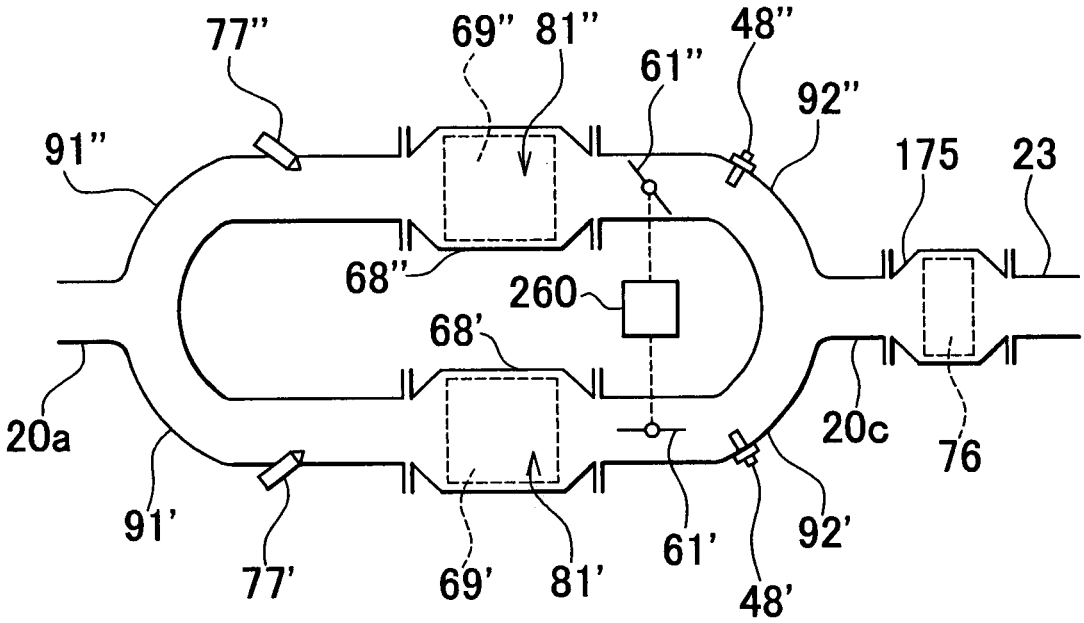
FIG. 27 is a view representing another type of the internal combustion engine.

The aforementioned embodiments of the invention are applicable to the internal combustion engines as shown in FIGS. 25 and 27.

In the internal combustion engine as shown in FIG. 25, a casing 168 is connected to an outlet of the exhaust pipe 20*a*, and is further connected to a casing 175 via the exhaust pipe 20*c*. The casing 175, then, is connected to the exhaust pipe 23. The particulate filter 69 that carries the $NO_X$ catalyst 81 and the auxiliary catalyst 76 are provided within the casings 168, 175, respectively.

A bypass pipe 185 is branched from the exhaust pipe 20*a*, an outlet end of which is opened to the exhaust pipe 20*c*. A selector valve 161 controlled by an electronic control unit (not shown) is provided in a point where an inlet end of the bypass pipe 185 is connected with the exhaust pipe 20*a*. The reducing agent supply valve 77 is provided in the exhaust pipe 20*a* at a point between the inlet end of the bypass pipe 185 and the particulate filter 69. The exhaust sensor 48 is provided in the exhaust pipe 20*c* at a position between the particulate filter 69 and the outlet end of the bypass pipe 185.

Figure 26:
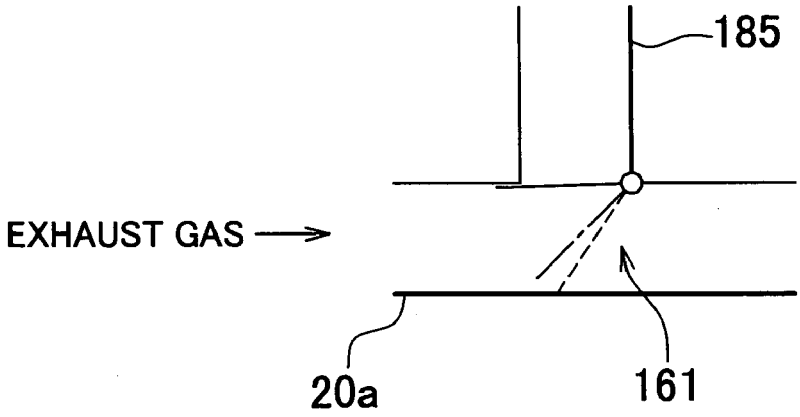
FIG. 26 is a view that shows the position of the selector valve of the internal combustion engine as shown in FIG. 25.

The selector valve 161 is held in a normal position as shown by a solid line in FIG. 26. When the selector valve 161 is held in the normal position, the bypass pipe 185 is blocked such that most of the exhaust gas flowing into the exhaust pipe 20*a* is guided into the particulate filter 69. Accordingly, the normal position of the selector valve 161 corresponds to the forward flow position or the reverse flow position of the selector valve 61 in the internal combustion engine as shown in FIG. 1.

When the control of reducing the stored $NO_X$ or stored $SO_X$ is required, the reducing agent is supplied through the reducing agent supply valve 77 while holding the selector valve 161 in the weak flow position as shown by a chain line in FIG. 26. When the selector valve is held in the weak flow position, a small part of the exhaust gas flowing into the exhaust pipe 20*a* is guided in the particulate filter 69, and the rest of the exhaust gas is guided into the bypass pipe 185. Accordingly the weak flow position of the selector valve 161 shown in FIG. 26 corresponds to the weak forward flow position of the selector valve 61 in the internal combustion engine as shown in FIG. 1. When the selector valve 161 is held in the bypass position as shown by a dashed line in FIG. 26, the bypass pipe 185 is unblocked, allowing most of the exhaust gas flowing through the exhaust pipe 20*a* to bypass the particulate filter 69. Accordingly the bypass position of the selector valve 161 corresponds to the bypass position of the selector valve 61 in the internal combustion engine shown in FIG. 1.

In an internal combustion engine as shown in FIG. 27, the exhaust pipe 20*a* constitutes a Y-like pipe having a pair of branch pipes 91' and 91". Each outlet of the respective branch pipes is connected to casings 68', 68" which are connected to branch pipes 92', 92" of the exhaust pipe 20*c*, respectively. They are further connected to a casing 175 via the exhaust pipe 20*c*, The casing 175 is connected to the exhaust pipe 23. Those casings 68', 68" have the first and the second particulate filters 69', 68". The first and the second particulate filters 69', 69" carry the first and the second $NO_X$ catalysts 81', 82", respectively.

There are first and second selector valves 61', 61" each driven by a common actuator 160 within the branch pipe of the exhaust pipe 20*c*, and the first and the second sensors 48', 48", respectively. The branch pipe of the exhaust pipe 20*a* has the first and the second reducing agent water supply valves 77', 77" in the branch pipe of the exhaust pipe 20*a*. The actuator 160 and the reducing agent supply valve 77', 77" are controlled by the electronic control unit (not shown).

Figure 28A:
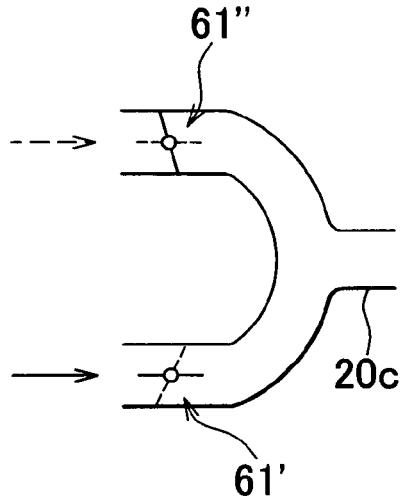
FIGS. 28A and 28B are views each representing the position of the selector valve of the internal combustion engine as shown in FIG. 27.

The selector valves 61', 61" are held in the first normal positions as shown by the solid lines in FIG. 28A, or in the second normal positions as shown by the dashed lines in FIG. 28A. When the selector valves 61', 61" are held in the first normal positions, the first selector valve 61' is held in a full open position, and the second selector valve 61" is held in a full close position. As shown by the solid arrow in FIG. 28A, almost all the exhaust gas flowing into the exhaust pipe 20*a* is guided into the first $NO_X$ catalyst 81'. Meanwhile when the selector valves 61', 61" are held in the second normal positions, the first selector valve 61' is held in the full close position, and the second selector valve 61" is held in the full open position. As shown by a dashed arrow in FIG. 28A, almost all the exhaust gas flowing into the exhaust pipe 20*a* is guided into the second $NO_X$ catalyst 81". The first and the second normal positions of the selector valves 61', 61"

correspond to the normal position or the bypass position of the selector valve 161 in the internal combustion engine shown in FIG. 20.

Figure 28B:
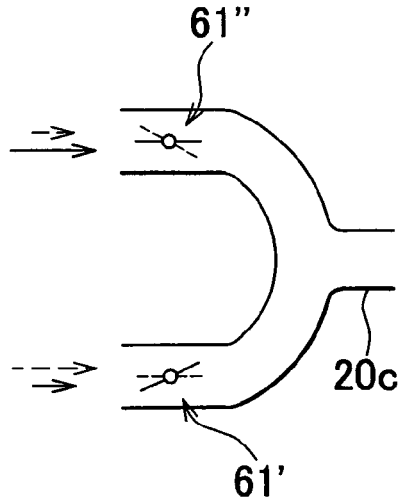

When the control of reducing $NO_X$ or $SO_X$ stored in the first $NO_X$ catalyst 81' is required, the reducing agent is supplied while holding the selector valves 61', 61" in the first weak flow positions as shown by the solid lines in FIG. 28B. When the selector valves 61', 61" are held in the first weak flow positions, a small part of the exhaust gas flowing into the exhaust pipe 20*a* is guided into the first $NO_X$ catalyst 81', and the rest of the exhaust gas is guided into the second $NO_X$ catalyst 81". When the control of reducing the $NO_X$ or $SO_X$ stored in the second $NO_X$ catalyst 81" is required, the reducing agent is supplied while setting the selector valves 61', 61" in the second weak flow position so as to be held as shown in the dashed lines in FIG. 28B. When the selector valves 61', 61" are held in the second weak flow positions, a part of the exhaust gas flowing into the exhaust pipe 20*a* is guided into the second $NO_X$ catalyst 81", and the rest of the exhaust gas is guided into the first $NO_X$ catalyst 81'. The weak flow positions of the selector valves 61', 61" correspond to the weak forward flow position of the selector valve 61 in the internal combustion engine as shown in FIG. 1.

Generally the $NO_X$ catalyst is provided within the exhaust passage, from where the bypass passage is branched to bypass the $NO_X$ catalyst. The selector valve is further provided to control the flow rate of the exhaust gas that flows through the $NO_X$ catalyst by controlling the flow rate of the exhaust gas flowing through the bypass passage. Then the reducing agent supply valve is provided to supply the reducing agent into the exhaust passage between the branch portion of the bypass passage and the $NO_X$ catalyst.

The internal combustion engine shown in FIG. 1 is allowed to select the flow of the exhaust gas into the $NO_X$ catalyst between a direction from one end surface to the other end surface and a direction reverse thereto.

In the internal combustion engine shown in FIG. 27, the exhaust passage from the branch pipe 91" of the exhaust pipe 20*a* to the branch pipe 92" of the exhaust pipe 20*c* may be regarded as serving as the bypass passage with respect to the exhaust passage from the branch pipe 91' of the exhaust pipe 20*a* to the branch pipe 92' of the exhaust pipe 20*c*, In this case, the second reducing agent supply valve 77', the second particulate filter 69", and the second $NO_X$ catalyst 81" may be regarded as additional reducing agent supply valve, particulate filter, and the $NO_X$ catalyst, respectively.

The aforementioned embodiments make it possible to hold the flow rate of the exhaust gas that flows through the $NO_X$ catalyst upon supply of the reducing agent through the reducing agent supply valve to an optimum value.

What is claimed is:

1. An exhaust emission control apparatus of an internal combustion engine in which combustion is continuously performed at a lean air/fuel ratio, the exhaust emission control apparatus comprising:

a $NO_X$ catalyst provided in a looped exhaust passage of the internal combustion engine for storing $NO_X$ contained in an exhaust gas at a lean air/fuel ratio flowing into the exhaust passage, and reducing the stored $NO_X$ in the presence of a reducing agent in the exhaust gas when the air/fuel ratio of the exhaust gas is lowered, a flow direction of the exhaust gas being reversed within the exhaust passage under predetermined conditions, a reducing agent supply valve that is provided in the exhaust passage upstream of the $NO_X$ catalyst, through which the reducing agent is supplied to the $NO_X$ catalyst, an exhaust state detector that detects a state of the exhaust gas flowing through the $NO_X$ catalyst, and a controller that executes (1) a reducing agent supply control by temporarily decreasing the flow rate of the exhaust gas and supplying the reducing agent from the reducing agent supply valve and (2) a correction control to correct a control parameter used in the reducing agent supply control in accordance with an exhaust state value that is obtained from an output of the exhaust state detector after the reducing agent has been supplied from the reducing agent supply valve, wherein, during the correction control, the controller determines a time period elapsing from a predetermined reference timing until the exhaust state value reaches a peak after the supply of the reducing agent from the reducing agent supply valve, and corrects the control parameter such that the time period equals a target time period.

2. The exhaust emission control apparatus according to claim 1, wherein, during the correction control, the controller compares the exhaust state value with a target exhaust state value and corrects the control parameter so as to bring the exhaust state value to the target exhaust state value.

3. The exhaust emission control apparatus according to claim 1, wherein, before or after the reducing agent supply control, the controller executes a reducing agent amount correction by supplying a target amount of the reducing agent from the reducing agent supply valve, and correcting a value of the target amount based on an output of the exhaust state sensor that is obtained after the target amount of the reducing agent has been supplied.

4. The exhaust emission control apparatus according to claim 1, wherein the temporal decrease in the flow rate of the exhaust gas is accomplished by continuously changing the flow rate of the exhaust gas.

5. The exhaust emission control apparatus according to claim 1, wherein the temporal decrease in the flow rate of the exhaust gas is accomplished by holding the flow rate of the exhaust gas at a particular rate.

6. The exhaust emission control apparatus according to claim 1, wherein the controller controls a length of a time period to supply the reducing agent from the reducing agent supply valve on the basis of the exhaust state value.

7. The exhaust emission control apparatus according to claim 1, wherein the exhaust state value comprises at least one of an oxygen concentration of the exhaust gas, a temperature of the exhaust gas, a $NO_x$ concentration of the exhaust gas, and a reducing agent concentration of the exhaust gas.

8. The exhaust emission control apparatus according to claim 7, wherein the target exhaust state value corresponds to at least one of a maximum value of the exhaust state value and a minimum value of the exhaust state value.

9. An exhaust emission control method of an internal combustion engine in which combustion is continuously performed at a lean air/fuel ratio, and a $NO_x$ catalyst is provided in an exhaust passage of the internal combustion engine for storing $NO_x$ contained in a looped exhaust gas at a lean air/fuel ratio flowing into the exhaust passage, and reducing the stored $NO_x$ in the presence of a reducing agent in the exhaust gas when the air/fuel ratio of the exhaust gas is lowered, a flow direction of the exhaust gas being reversed within the exhaust passage under predetermined conditions, a reducing agent supply valve is provided in the exhaust passage upstream of the $NO_x$ catalyst, through which the reducing agent is supplied to the $NO_x$ catalyst, and an exhaust state detector that detects a state of the exhaust gas flowing through the $NO_x$ catalyst, the exhaust emission control method comprising:

executing (1) a reducing agent supply control by temporarily decreasing the flow rate of the exhaust gas and supplying the reducing agent from the reducing agent supply valve and (2) a correction control to correct a control parameter used in the reducing agent supply control in accordance with an exhaust state value that is obtained from an output of the exhaust state detector after the reducing agent has been supplied from the reducing agent supply valve, wherein, during the correction control, a time period elapsing is determined from a predetermined reference timing until the exhaust gas value reaches a peak after the supply of the reducing agent from the reducing agent supply valve with a target time period, and the control parameter is corrected such that the time period equals a target time period.

10. The exhaust emission control method according to claim 9, wherein, during the correction control, the exhaust state value is compared with a target exhaust state value and the control parameter is corrected so as to bring the exhaust state value to the target exhaust state value.

11. The exhaust emission control method according to claim 9, wherein, before or after the reducing agent supply control, a reducing agent amount correction is executed by supplying a target amount of the reducing agent from the reducing agent supply valve, and a value of the target amount is corrected based on an output of the exhaust state sensor that is obtained after the target amount of the reducing agent has been supplied.

12. The exhaust emission control method according to claim 9, wherein the temporal decrease in the flow rate of the exhaust gas is accomplished by continuously changing the flow rate of the exhaust gas.

13. The exhaust emission control method according to claim 9, wherein the temporal decrease in the flow rate of the exhaust gas is accomplished by holding the flow rate of the exhaust gas at a particular rate.

14. The exhaust emission control method according to claim 9, wherein a length of a time period taken to supply the reducing agent from the reducing agent supply valve is controlled on the basis of the exhaust value.

15. The exhaust emission control method according to claim 9, wherein at least one of an oxygen concentration of the exhaust gas, a temperature of the exhaust gas, a $NO_x$ concentration of the exhaust gas, and a reducing agent concentration of the exhaust gas is detected as the exhaust state value.

16. The exhaust emission control method according to claim 15, wherein the target exhaust state value corresponds to at least one of a maximum value of the exhaust state value and a minimum value of the exhaust state value.

* * * * *